United States Patent [19]

Wilson

[11] Patent Number: 4,917,533

[45] Date of Patent: Apr. 17, 1990

[54] RESURFACING APPARATUS AND PROCESS

[75] Inventor: Jack H. Wilson, Jackson, Miss.

[73] Assignee: Sport Koter U.S.A., Inc., Jackson, Miss.

[21] Appl. No.: 230,029

[22] Filed: Aug. 9, 1988

Related U.S. Application Data

[63] Continuation-in-part of Ser. No. 309,963, Feb. 13, 1989, which is a continuation of Ser. No. 117,495, Nov. 6, 1987, abandoned, which is a continuation-in-part of Ser. No. 10,936, Feb. 5, 1987, Pat. No. 4,789,265.

[51] Int. Cl.[4] ..... E01C 19/16

[52] U.S. Cl. ..... 404/75; 404/96; 404/101; 427/136; 118/108

[58] Field of Search ..... 404/72, 75, 96, 97, 404/101, 111, 118, 93, 94; 118/108, 207; 427/136–138, 272; 156/247; 15/49 R, 78, 79 R, 98, 117, 160, 172

[56] References Cited

U.S. PATENT DOCUMENTS

| | | | |
|---|---|---|---|
| 1,142,698 | 6/1915 | Grove et al. | 15/117 |
| 1,714,397 | 5/1929 | Nissly | 15/79 R X |
| 2,101,769 | 12/1937 | Westmoreland | 15/78 |
| 2,182,217 | 12/1939 | Wahlstrom et al. | 404/101 |
| 2,635,272 | 4/1953 | Johnson | 15/145 X |
| 2,741,788 | 4/1956 | Shey | 15/105 |
| 3,052,167 | 9/1962 | Beale | 404/85 |
| 3,174,413 | 3/1965 | Wittmack, Jr. | 404/118 |
| 3,283,675 | 11/1966 | Gifford et al. | 404/111 |
| 3,841,779 | 10/1974 | Ray | 404/111 |
| 4,379,187 | 4/1983 | Seman | 427/272 X |
| 4,678,365 | 7/1987 | Ban et al. | 404/118 |
| 4,747,174 | 5/1988 | Hightower | 15/49 R X |
| 4,789,265 | 12/1988 | Wilson et al. | 404/75 |
| 4,793,731 | 12/1988 | Gnesa | 404/111 X |

*Primary Examiner*—Jerome W. Massie
*Assistant Examiner*—Matthew Smith
*Attorney, Agent, or Firm*—Nixon & Vanderhye

[57] ABSTRACT

An improved method and apparatus are provided for resurfacing recreational (e.g., tennis) courts and other surfaces. The apparatus includes self-contained drive means including drive wheels mounted on an elongated frame structure, and additionally supported for rolling movement on a plurality of casters. The apparatus is provided with flexible blade and brush elements for spreading and smoothing court resurfacing material uniformly across the surface. In a forward resurfacing direction, flexible squeegee-type blades, with or without associated brushes, engage the resurfacing material ahead of the device, while flexible brush elements engage the resurfacing material behind the device to erase tracks caused by the drive wheels and casters, and to effect final smoothing and texturing of the resurfacing material. The drive wheels may be moved into and out of ground engaging contact, and a steering device provides for lifting one or the other of the drive wheels out of ground engaging contact. The device is movable in one direction to resurface an entire tennis court in a single pass. In a related aspect, tape is applied over the court boundary lines prior to resurfacing, and removed after resurfacing. Multiple coats of resurfacing material may be applied, in the same, or different directions.

25 Claims, 13 Drawing Sheets

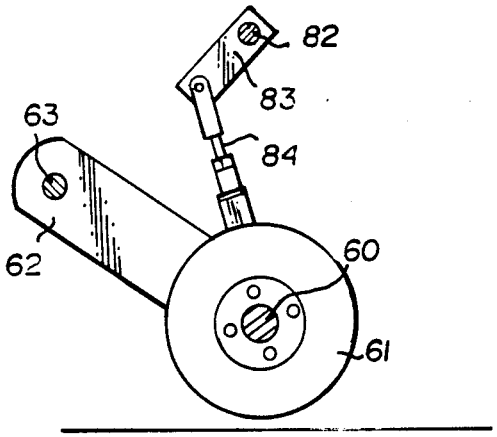
FIG. 8
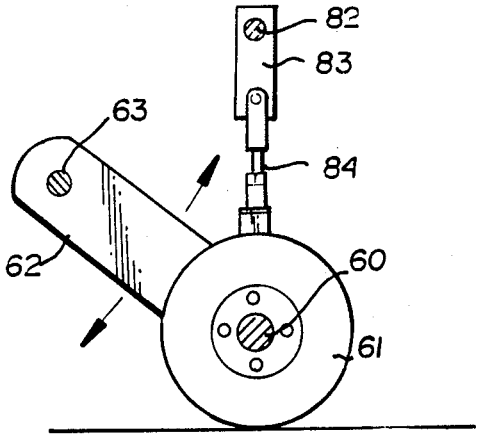
FIG. 7
FIG. 9
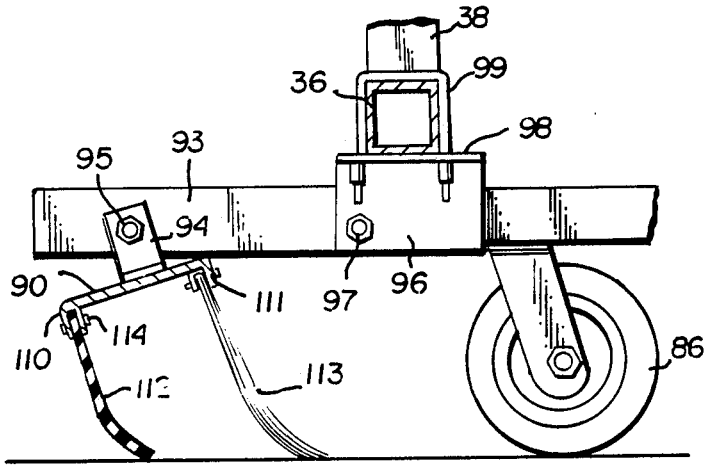
FIG. 10
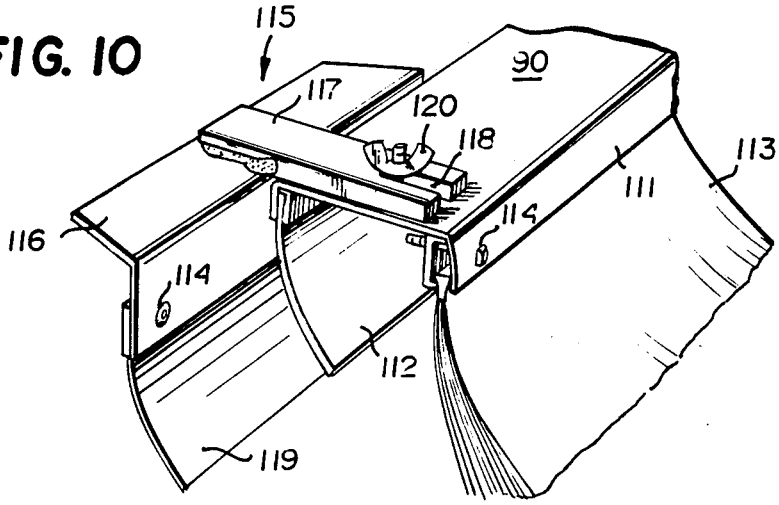

FIG. 10a
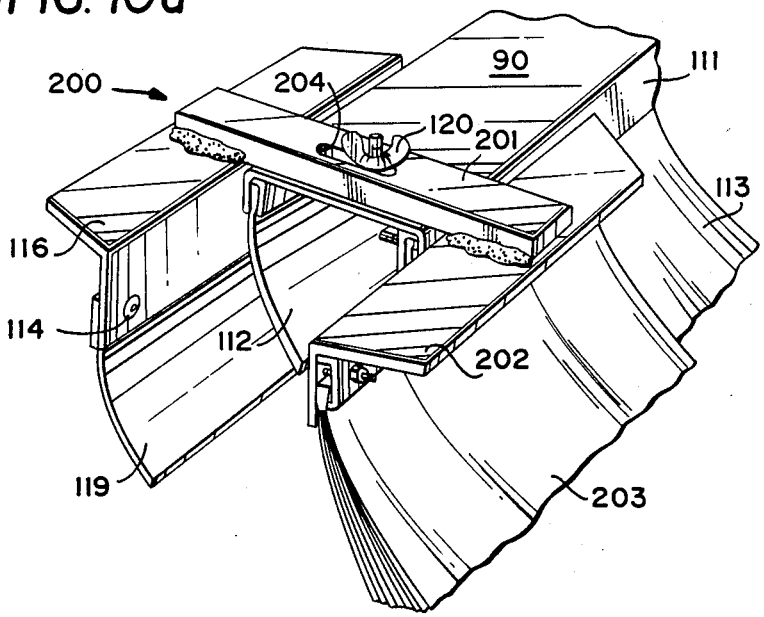
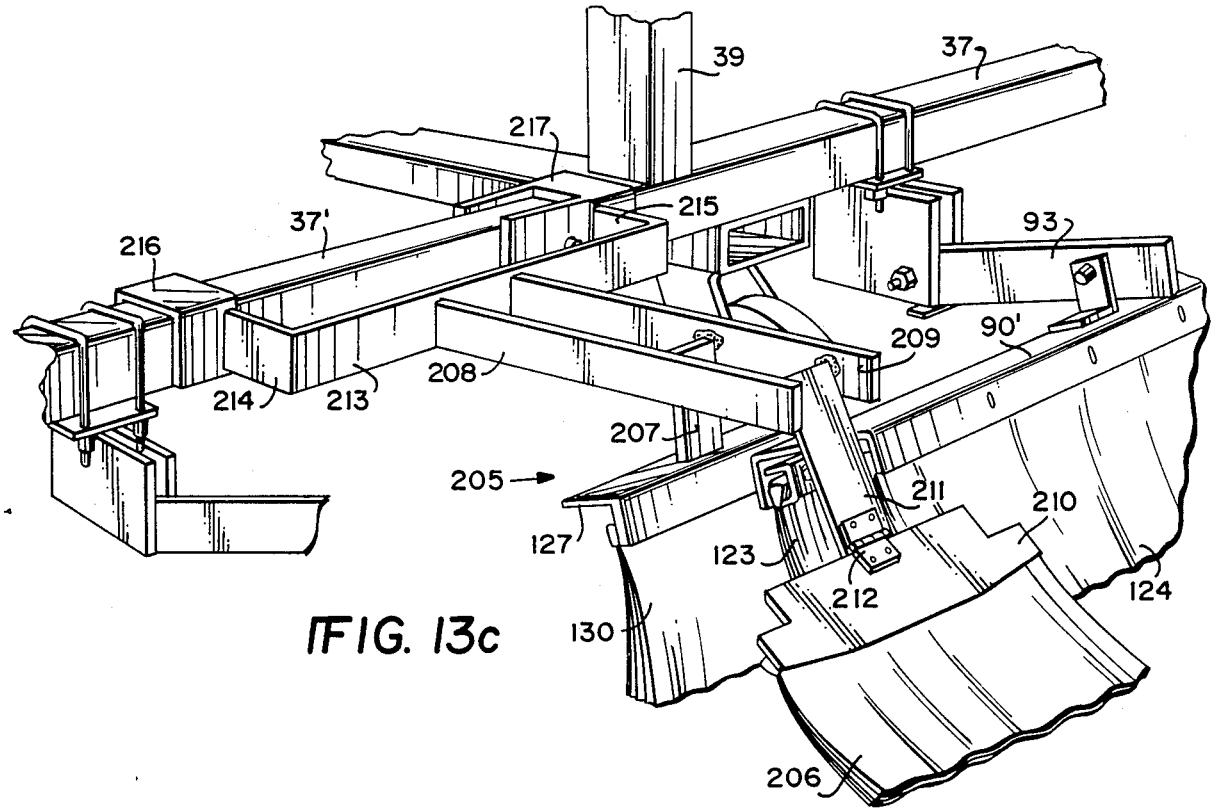
FIG. 13c

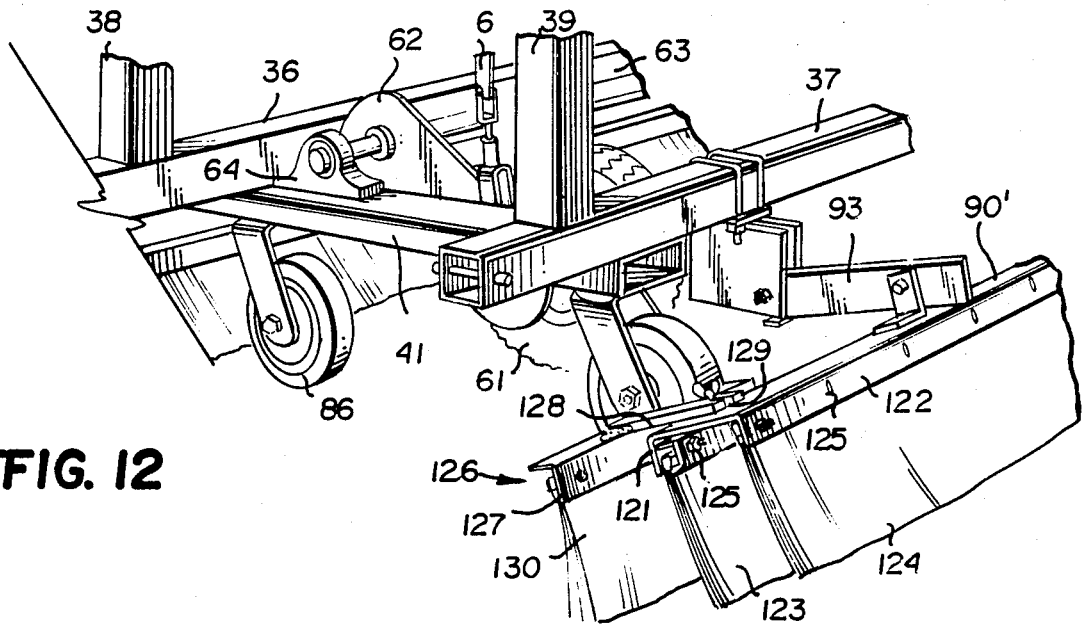
FIG. 12
FIG. 11
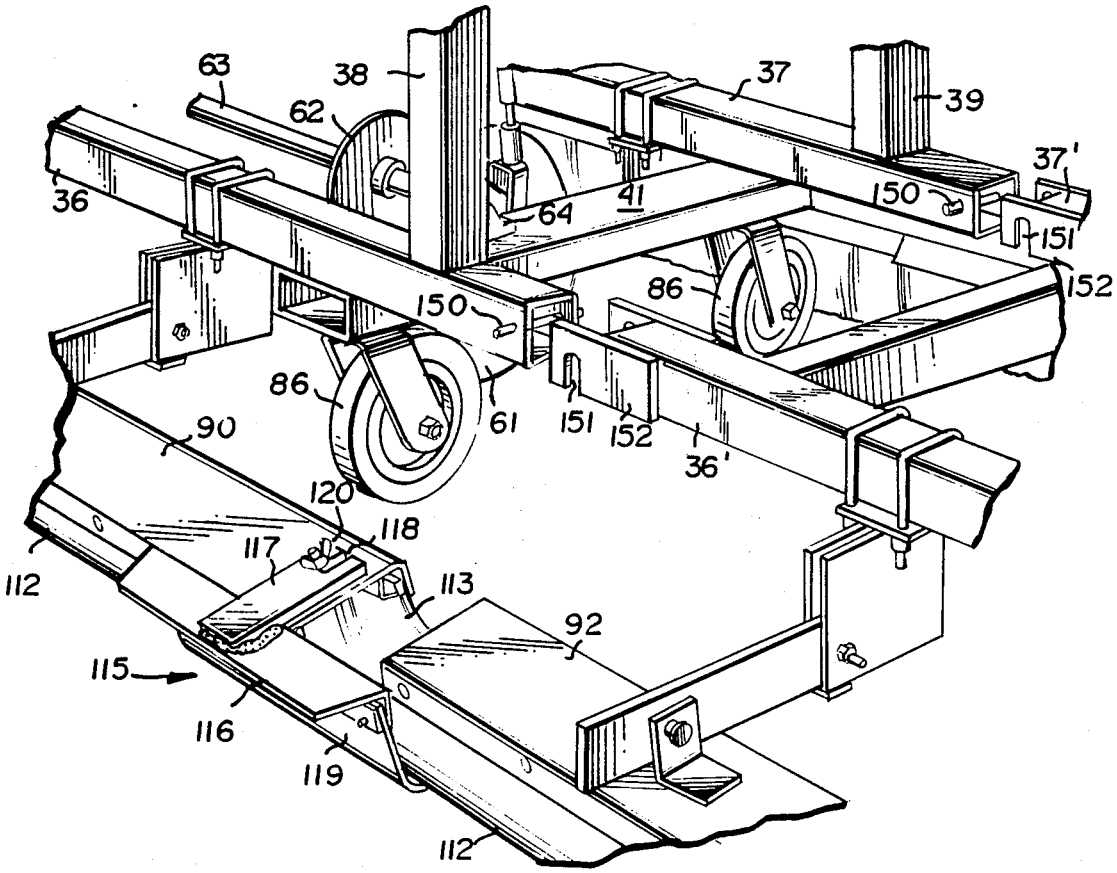

FIG. 13
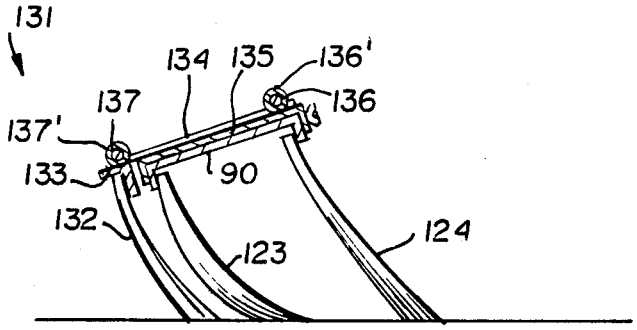
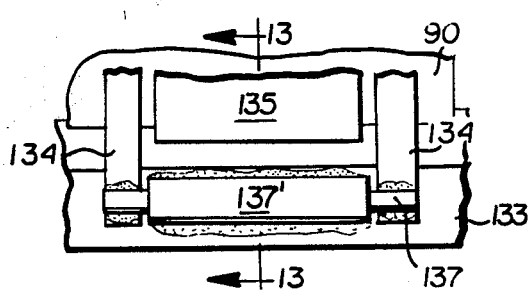
FIG. 13a
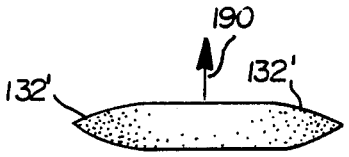
FIG. 13b
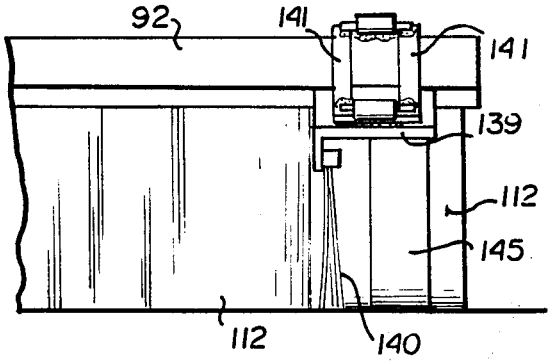
FIG. 14
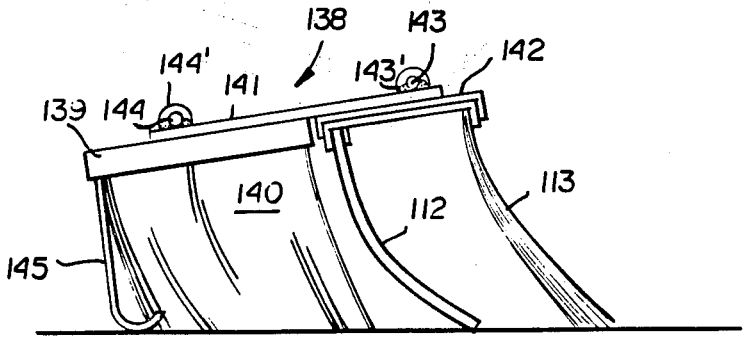
FIG. 15

RESURFACING APPARATUS AND PROCESS

This application is continuation-in-part of co-pending application Ser. No. 309,963, filed February 13, 1989, which is a continuation of Ser. No. 117,495, filed November 6, 1987, abandoned; which in turn is a continuation-in-part of application Ser. No. 010,936, filed February 5, 1987, and now U.S. Pat. No. 4,789,265.

BACKGROUND AND SUMMARY OF THE INVENTION

This invention relates to the repair and maintenance of surfaces such as indoor or outdoor, hard recreational surfaces and, particularly, to the resurfacing of tennis courts, basketball courts and the like. In addition, the invention has equal applicability to the maintenance of concrete and asphalt pavements such as parking lots, driveways, air strips, courtyards, patios, factory floors and virtually any hard surface which requires periodic coating with a sealant or like composition.

In the past, acrylic resurfacing material typically employed for tennis courts has been applied manually and thereafter spread about by a number of individuals working with hand-held, squeegee-like spreaders, typically 30" in width. The resulting surface coating often varies in thickness and exhibits unsightly streaks resulting from the uneven application and multi-directional spreading techniques common in the prior art. The surface coating can range from thin to thick and, as a result, often shows noticeable deterioration even within one year after resurfacing. Manual application is also labor intensive, time consuming and therefore very costly. More importantly, a quality result is not assured.

Conventional seal coating machines used to resurface and/or seal pavements also have disadvantages and oftentimes do not perform in a satisfactory manner. For example, in many cases, the sealant is sprayed onto the surface from a plurality of nozzles located proximate to a squeegee or brush which then spreads the material as the device is pulled or driven across the surface. However, sealants (such as coal tar sealant) are often toxic, and spraying such compositions, particularly on windy days, poses potential health hazards. In addition, sprayed sealants can be blown on autos, buildings, etc. in the vicinity of the sealing operation.

Typically, sprayed or poured sealant compositions are spread with a fairly stiff, hard rubber squeegee which is generally oriented substantially vertical relative to the ground. This arrangement, whether manual or machine operated, is unsatisfactory because the squeegee blade bridges over low spots, leaving puddles of sealant which eventually bubble and burst, causing premature peeling of the sealant coating.

According to this invention, an improved apparatus and a process for resurfacing virtually any relatively hard and flat pavement surfaces are provided which overcome the above mentioned problems associated with prior art resurfacing techniques.

The present invention, in one exemplary embodiment, relates to a mobile, self-propelled device which can spread and smooth resurfacing material uniformly over an entire recreational court surface, and adjacent slab surfaces, in a single pass. This, of course, represents a fraction of the time required by conventional manual application techniques typically employed in the resurfacing of tennis courts. The present invention not only permits significantly more rapid resurfacing, but also provides a far superior uniformity of thickness throughout the resurfaced area, regardless of the type of surface.

In the earlier filed applications, a resurfacing apparatus and process are disclosed which offer many advantages over conventional court resurfacing techniques. This invention relates to further improvements over the earlier disclosed apparatus and processes.

According to one exemplary embodiment of the invention, an elongated frame, preferably constructed in three separable but substantially axially aligned sections, is supported on a plurality of freely rotatable casters. The total width of the three-section frame may be varied as desired but, for coating regulation tennis courts, exceeds the width boundary of the court. Other sizes may be achieved by shortening or lengthening any or all of the frame sections, and/or by removing altogether the separable side sections, depending on the size of the surface to be refinished. For tennis court applications, the center frame section is approximately 20 feet wide, and each side or wing section is approximately 19 feet wide, so that the court as well as adjacent areas of the slab may be resurfaced in a single pass.

This continuation-in-part application also provides means by which the sealant may be confined longitudinally in the direction of movement of the machine, to any predetermined width within the overall width of the apparatus, whether or not the separable side sections are employed. This arrangement is particularly suited for two-color coating of court surfaces. It will be further appreciated that this arrangement allows a single size apparatus to be adapted to any number of surfaces or pavements of differing widths.

An internal combustion engine is utilized to drive the device. The engine is preferably mounted on the center section of the frame along with a centrifugal clutch, a forward-neutral-reverse transmission, and a roller drive train to a live drive axle mounting a pair of drive wheels. The ends of the live drive axle are supported for pivotal movement between an operative positive ground-engaging position, a neutral position, and an inoperative position in which both drive wheels are raised above the ground. To this end, a unique torsional shaft arrangement allows about 80% of the weight of the center section of the frame to be directed onto the drive wheels for increased traction in the operating position. Rotation of the torsional shaft to raise or lower the drive wheels is accomplished by a hand crank manually actuated by the machine operator.

The resurfacing apparatus of this invention may also be steered by actuating one or the other of two upstanding levers, located on either side of a driver's seat mounted substantially in the middle of the center section. Each lever is operatively connected to a respective drive wheel. By rotating, for example, the right lever, the right drive wheel is lifted clear of the ground, thereby losing its traction. The left drive wheel, however, maintains its positive ground engagement and produces full traction so as to pull the left end of the unit ahead of the right end. Thus, actuating the right or left steering lever produces a braking action on the right or left end, respectively, of the unit, thereby permitting the unit to be steered as desired. The above described torsional shaft also permits the steering levers to act independently of one another, and without negative impact on the mechanism employed to raise and lower the drive wheels between operative and inoperative positions.

It should be understood, however, that once the device is accurately aligned, motor started and drive wheels engaged, the operator need not remain seated on the device, but may walk along side it as it moves across the surface. Only if it becomes apparent that the device is beginning to move off course does the operator need to mount the unit and redirect the unit via the steering mechanism.

The two side frame sections which are substantially identical, are releasably attached to the center frame section for ease of transport and/or storage. The side sections are passive in the sense that they contain no portion of the drive train or steering systems of the unit.

Extending along front and rear faces of the unit are a plurality of channel members, each of which includes web and flange portions. Three such channel members are pivotally mounted to the three respective frame sections along both the front and rear faces of the unit. Thus, in one exemplary embodiment, a total of six such channel members are employed. The channel members along the front and rear of the machine, respectively, are in substantial axial alignment, and at the same time, are mounted substantially independently of each other such that all of the channel members are free to float relative to the frame sections to which they are attached.

Front and rear flanges of the channel members extending across the front face of the unit support leading squeegee-type blades and a trailing bristle brushes, respectively. Along the rear face of the machine, aligned channel members each mount leading and trailing bristle brushes.

As used herein, the term "leading" indicates that the so-described component contacts the resurfacing material ahead of the "trailing" component. Further, the channels which extend along the front of the machine, and their associated squeegee-type blades and brushes, will be referred to as the "lead" or "leading" applicator, while the channel members which extend across the rear face of the unit, and their respective bristle brushes will be referred to as the "rear" or "trailing" applicator.

The above described arrangement is such that the leading squeegee-type blade of the lead applicator contacts the resurfacing material first, and pushes the majority of the material ahead of the machine, but allows a limited quantity to flow underneath the blade. The trailing bristle brush of the lead applicator serves to further thin out and smooth the resurfacing material.

The leading and trailing brushes of the trailing applicator serve to even further spread and thin out the resurfacing material and, significantly, they function to eliminate tracks formed in the wetted surface by the drive wheels and casters, and create a finished texture in the acrylic material.

It is a further feature of this continuation-in-part application to provide improved squeegee-type blades and brush assemblies which serve to cover gaps which are present between adjacent channel sections of both the leading and trailing applicators. The improved gap brushes of the trailing applicator are attached directly to the machine frame rather than to the associated trailing applicator. The blade and brush gap device of the leading applicator is now made as a single, integrated unit, mounted on the leading applicator channel member as described further herein.

It is a further feature of the invention to provide end brushes which extend substantially perpendicularly forward of both the leading and trailing applicators so as to confine the resurfacing material within well defined boundaries, extending in the direction of machine movement. This is particularly advantageous for two-tone tennis court refinishing operations where the "in-bounds" color differs from the "out of bounds" color. In this continuation-in-part application, improved end brushes are provided which may be mounted to the separable side frame sections, or to the center frame section, for adjustable movement therealong to permit the machine operator to effectively set the desired width for the coating. Additional brush assemblies may be slidably inserted between the parallel flanges of the channel shaped applicators, and aligned with the end brush units to prevent any material from escaping laterally between the squeegees and brushes of the front applicator, or between the brushes of the rear applicator.

With regard to both the lead applicator and rear applicator, it is a further feature of the invention that each of the channel members may be rotated upwardly away from the ground, and latched in an inoperative position to further facilitate transport and/or storage of the device.

It is still another feature of this invention to provide at least one transport dolly, for facilitating transport of a frame center section, when separated from at least one of the frame side sections.

In still another aspect of this continuation-in-part application, a hand tool comprising a combination blade and brush is provided in order to finish off those areas surrounding the court or other surface which cannot be resurfaced by the machine. For example, when the principal resurfacing operation is completed, the apparatus is typically moved to an area adjacent the court, where it is cleaned. This leaves a relatively small remaining area, beyond the court boundaries and usually along a fence at the end of the slab, to be resurfaced. The hand applicator of this invention allows this area to be resurfaced in substantially the same manner as the principally resurfaced area. Similarly, small areas immediately adjacent any or all fences which typically enclose(s) a court surface and adjacent slab area, which cannot be reached by the apparatus, may also be resurfaced in this manner.

In another aspect, this invention relates to an improved process for resurfacing a tennis court (or other recreational court) or other relatively well defined surface. In the past, after an asphalt or "black-top" court, for example, has been resurfaced, it has been necessary to re-paint the boundaries which, of course, resulted in additional time and expense to complete the process. In accordance with this invention, a relatively simple process is provided which overcomes the disadvantages of conventional techniques. In the exemplary embodiment related to tennis or other recreational court surfaces, the process of this invention may be carried out as follows:

(a) covering existing painted court boundaries with strips of material, preferably adhesive-type tape which will not remove the paint when it is pulled up after the resurfacing operation;

(b) positioning a resurfacing device as described above adjacent, but outside the boundaries of the court, and preferably parallel to one of the end line, or width boundaries;

(c) applying resurfacing material, preferably a sand-filled acrylic material of predetermined viscosity, in front of the device, preferably along its entire width;

(d) moving the device forwardly along at least and preferably beyond the entire length and width of the court, spreading out and smoothing the resurfacing material by the leading and trailing applicators; and (e) removing the strips of tape to expose the original boundary lines.

In the event the original boundary lines are in need of re-painting, it is preferable that the re-painting be done first, followed by steps (a) through (e).

It will be appreciated that, in an alternative procedure, the machine may be positioned to travel in a direction transverse to the court length. This is particularly advantageous when resurfacing a number of adjacent courts, since all of the courts may be completely resurfaced in two passes of the machine. In other words, in one pass, one half of all of the courts (and areas adjacent the end lines on one side) may be resurfaced as the machine travels in one direction, and the other half of all of the courts (and areas adjacent the end lines on the other side) may be resurfaced as the machine returns in an opposite direction. In most instances, two courts are aligned in side-by-side relationship. When more than two courts are provided, adjacent pairs of courts are often separated by fences, light standards, or the like. Accordingly, it will be appreciated that in most instances, this alternative procedure will involve moving the machine in a direction parallel to the nets, and a distance of approximately one hundred twenty feet, to resurface one half of two adjacent court surfaces, from the nets to the fence or other barrier which extends parallel to the nets, beyond the court end lines. In a second pass in the opposite direction, the machine will resurface the other half of both courts, from the nets to the fence or other barrier beyond the opposite court end lines. Of course, if no barriers are presented between adjacent pairs of courts, the machine can resurface one half of all of the courts in a single pass, and resurface the other half in a return pass.

In addition, more than one coat may be applied as desired. In applying two coats, for example, a particularly attractive texture may be created by applying the second coat in a direction substantially perpendicular to the first. This procedure creates a striking "linen-like" texture to the court, created by the brushes on the trailing applicator.

Additional objects and advantages of the invention will become apparent upon reading the detailed description of the invention in conjunction with the accompanying drawings.

BRIEF DESCRIPTION OF THE DRAWINGS

FIGS. 7 and 8 are enlarged details illustrating the manner in which the drive wheels of the apparatus according to this invention may be raised or lowered between operative and inoperative positions;

FIG. 9 is a partial cross-sectional side view illustrating a squeegee-type blade and brush mounted in accordance with the present invention;

FIG. 10 is a partial perspective view illustrating a squeegee-type blade gap seal device in accordance with one exemplary embodiment of the invention;

FIG. 10*a* is a partial perspective view of a blade and brush gap seal device in accordance with a preferred embodiment of the invention;

FIG. 11 is a partial perspective view illustrating the manner in which a blade gap seal device of FIG. 10 overlaps the squeegee-type blades provided on the center and side sections of a leading applicator portion of the apparatus;

FIG. 12 is a partial perspective view illustrating a brush gap seal device in accordance with one exemplary embodiment the invention provided on the center section of a trailing applicator portion of the apparatus;

FIG. 13 is a partial cross-sectional view of a brush gap seal device in accordance with another exemplary embodiment of the invention taken along the line 13—13 of FIG. 13*a;*

FIG. 13*a* is a partial top view of the brush gap seal device illustrated in FIG. 13;

FIG. 13*b* is a bottom view of the brush portion of the brush gap seal devices of FIGS. 12 and 13;

FIG. 13*c* is a partial perspective view of a brush gap seal device in accordance with a preferred embodiment of the invention;

FIG. 14 is a partial front view illustrating an end brush in accordance with one exemplary embodiment of the invention;

FIG. 15 is a side view of the end brush illustrated in FIG. 14;

DETAILED DESCRIPTION OF THE DRAWINGS

Figure 1:
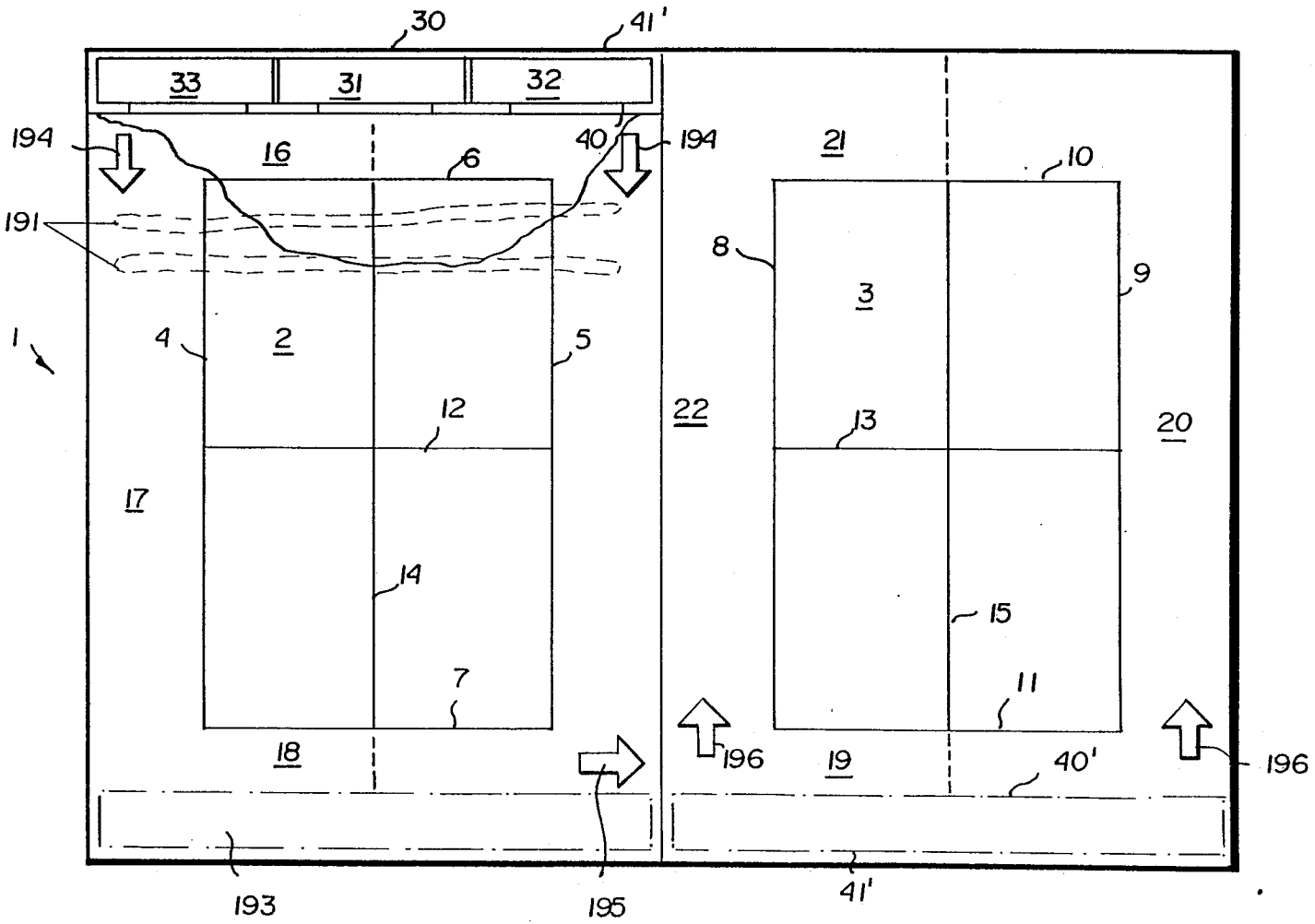
FIG. 1 is a schematic view of a resurfacing device in accordance with this invention, positioned for a resurfacing operation on a pair of adjacent tennis courts.

Referring now to FIG. 1, a typical multiple court configuration 1 includes a pair of side-by-side tennis courts 2, 3 laid out on a larger slab surface. Court 2 is defined by lengthwise boundary lines 4, 5 and widthwise boundary lines 6, 7. Similarly, court 3 is defined by lengthwise boundary lines 8, 9 and widthwise boundary lines 10, 11.

Typically, tennis courts are divided in half by imaginary lines 12, 13 which correspond to the location of nets (not shown). Court 2 is divided longitudinally by line 14 to define service areas while court 3 is similarly divided by line 15. In the context of this invention, lines 4, 5, 8 and 9 are considered the outer boundary lines typically employed in doubles matches. In other words, for machine alignment purposes, it is the outermost court boundaries that are significant, and other, interior lines, such as singles match boundaries and service lines need not be shown.

It will be appreciated that surrounding surfaces of the slab such as those indicated by reference numerals 16, 17, 18, 19, 20, 21, as well as the surface 22 between the two courts, typically have the same composition as the courts themselves, and are therefore subject to the same maintenance and repair requirements. Thus, any resurfacing operation would normally include all surfaces in surrounding relationship to the courts proper.

FIG. 1 also illustrates, generally, a resurfacing machine 30 positioned in surface area 16 outside the boundaries of court 2, and in generally parallel alignment with the widthwise boundary line 6.

The manner is which the apparatus or machine 30 is utilized to resurface such a court will be explained in detail further hereinbelow. It will be understood, of course, that the present invention may be used with similar advantages in the resurfacing or refinishing of any number of hard recreational court surfaces, as well as other relatively flat surfaces in relatively well defined areas such as those already mentioned above.

Figure 2:
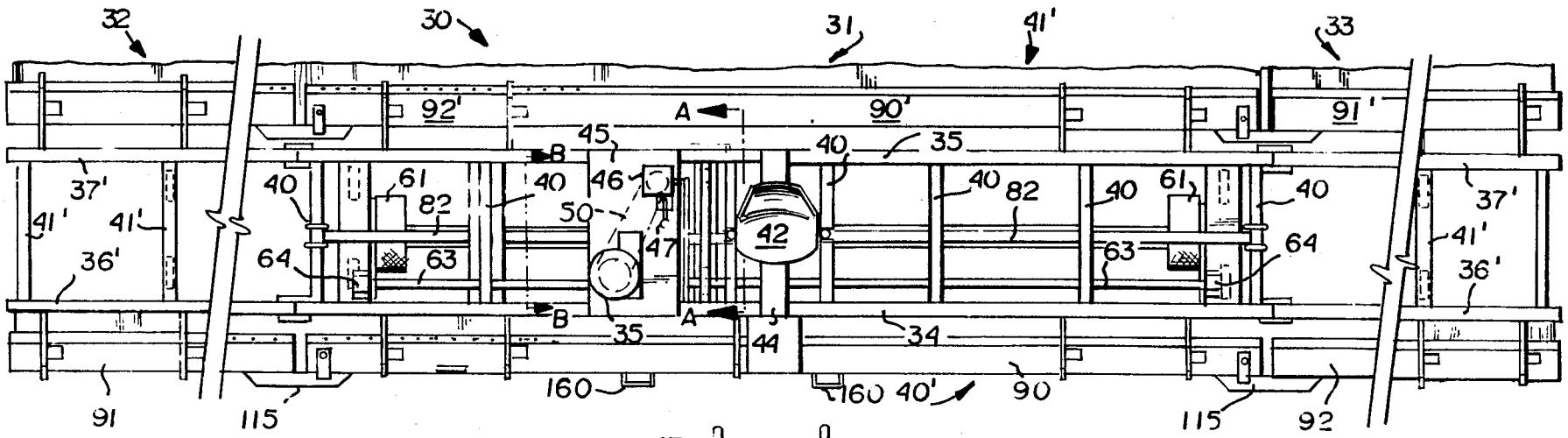
FIG. 2 is a partial top view of a resurfacing apparatus in accordance with this invention.
Figure 3:
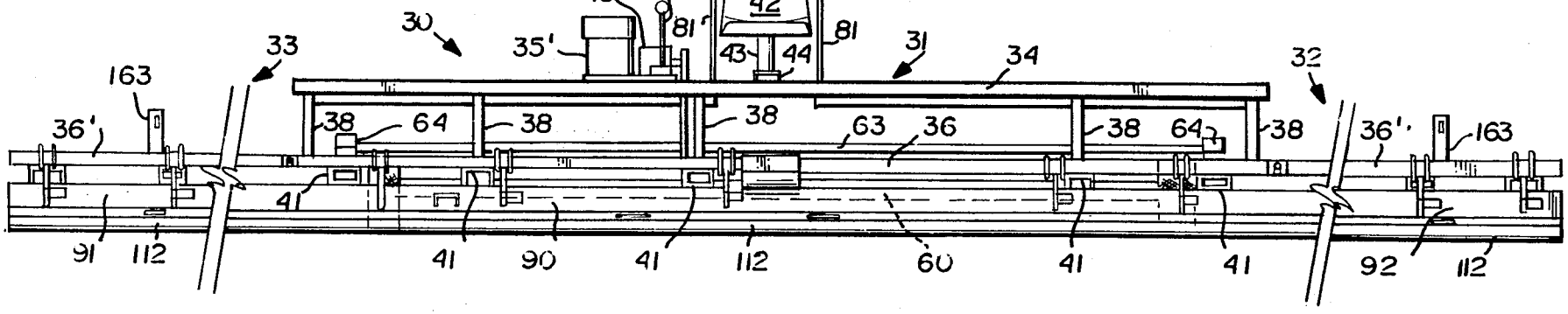
FIG. 3 is a partial front view of the resurfacing apparatus illustrated in FIG. 2.

Referring now to FIGS. 1–3, the overall structure and drive arrangement for the resurfacing device will be described in considerable detail. The device 30 comprises, essentially, an elongated structural frame including a center section 31 and separable left and right side sections 32, 33, respectively.

The center section is constructed in the form of a substantially rectangular box-like frame constructed, preferably, of welded 2″×2″16 gauge tubular steel including horizontal, upper front and rear beams 34, 35, and horizontal lower front and rear beams 36, 37, connected by a plurality of vertical front and rear connector beams 38, 39. To complete the box-like configuration, a plurality of upper and lower, horizontal connector beams 40, 41 extend between the front and rear faces F and R, respectively, of the device.

Each side section is formed by a substantially planar, horizontal frame section which, in effect, forms an extension of the lower portion of the center frame section. Thus, each side section includes lower front and rear beams 36′, 37′ respectively, connected by horizontal, front-to-rear connector beams 41′.

The center section also mounts an operator's chair, or seat, 42 on a seat post 43 which, in turn, is supported by a cross brace 44 which extends between upper front and rear beams 34, 35, respectively.

Also supported by the upper beams 34, 35 is a platform 45 which supports a motor M, as well as a conventional centrifugal clutch and transmission device (including forward, neutral and reverse gears) 46 provided with an operating shift lever 47. The motor M, which drives the unit, is preferably a 5 HP gasoline powered internal combustion engine.

Figure 6:
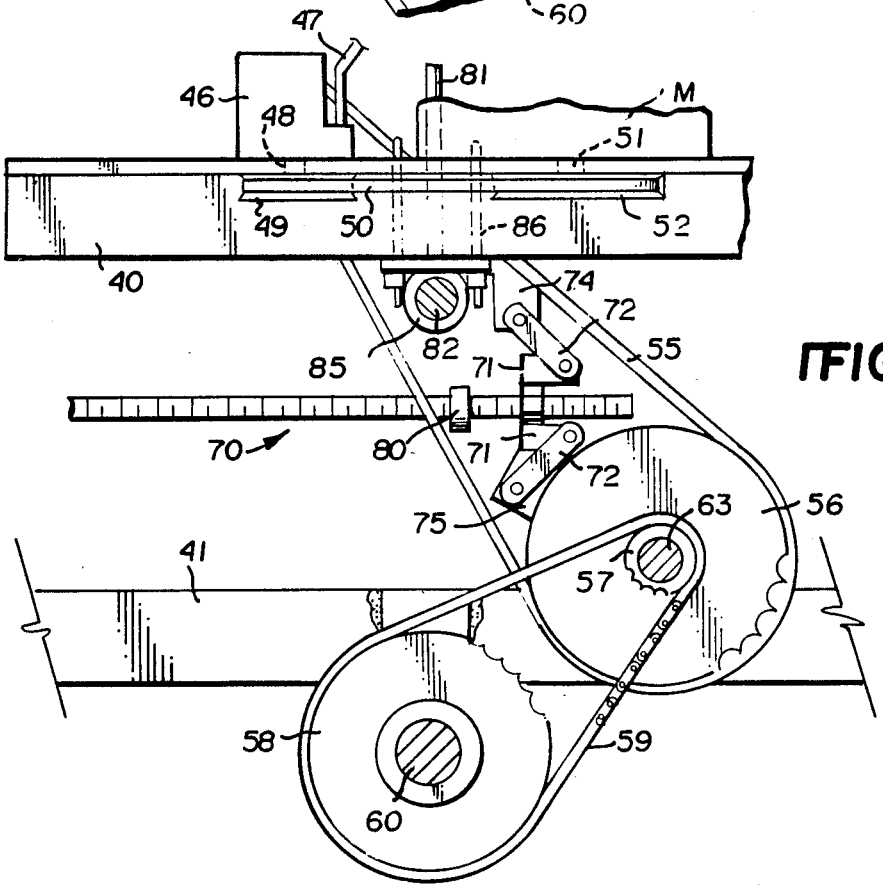
FIG. 6 is a partial side cross-sectional view taken along the line B—B of FIG. 2.

As best seen in FIGS. 2 and 6, the clutch mechanism includes an input shaft 48 to which a pulley 49 is attached. A drive belt 50 connects the clutch to the motor M by way of motor output shaft 51 and attached pulley 52. As can best be seen in FIG. 6, pulleys 49 and 52 are mounted for rotation about vertical axes, and are located just below the platform 45. The shift lever 47 extends upwardly from the clutch to a position adjacent and convenient to the operator from seat 42.

Figure 4:
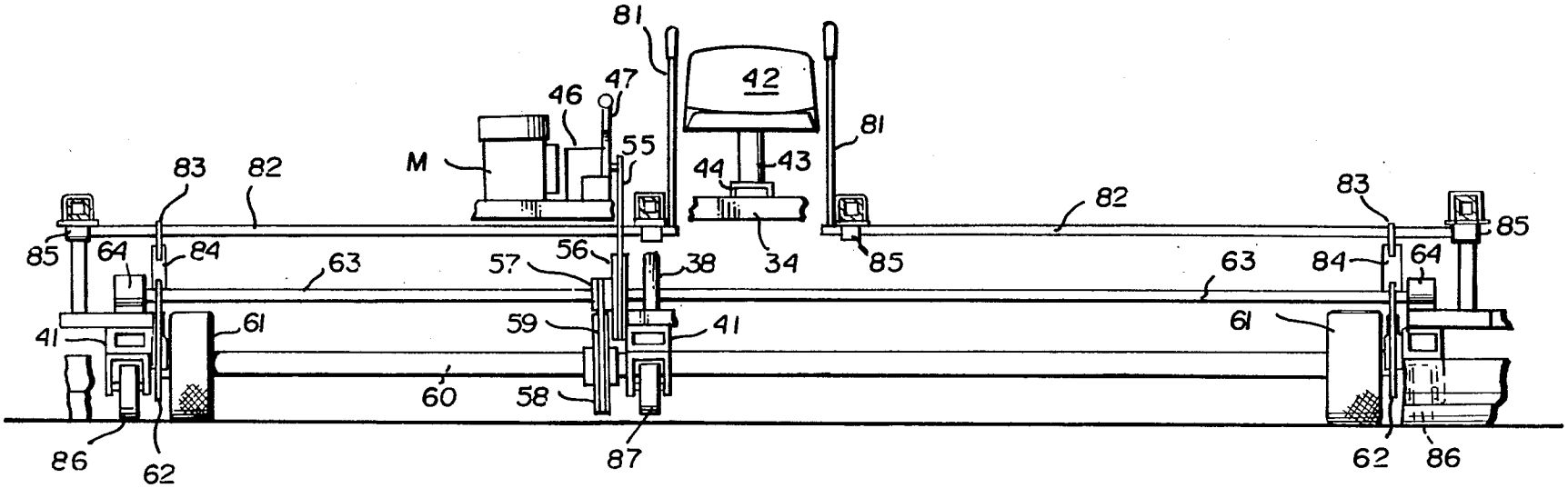
FIG. 4 is an enlarged front view of the center section view of the apparatus illustrated in FIG. 3, with parts removed to illustrate the drive train of the unit.
Figure 5:
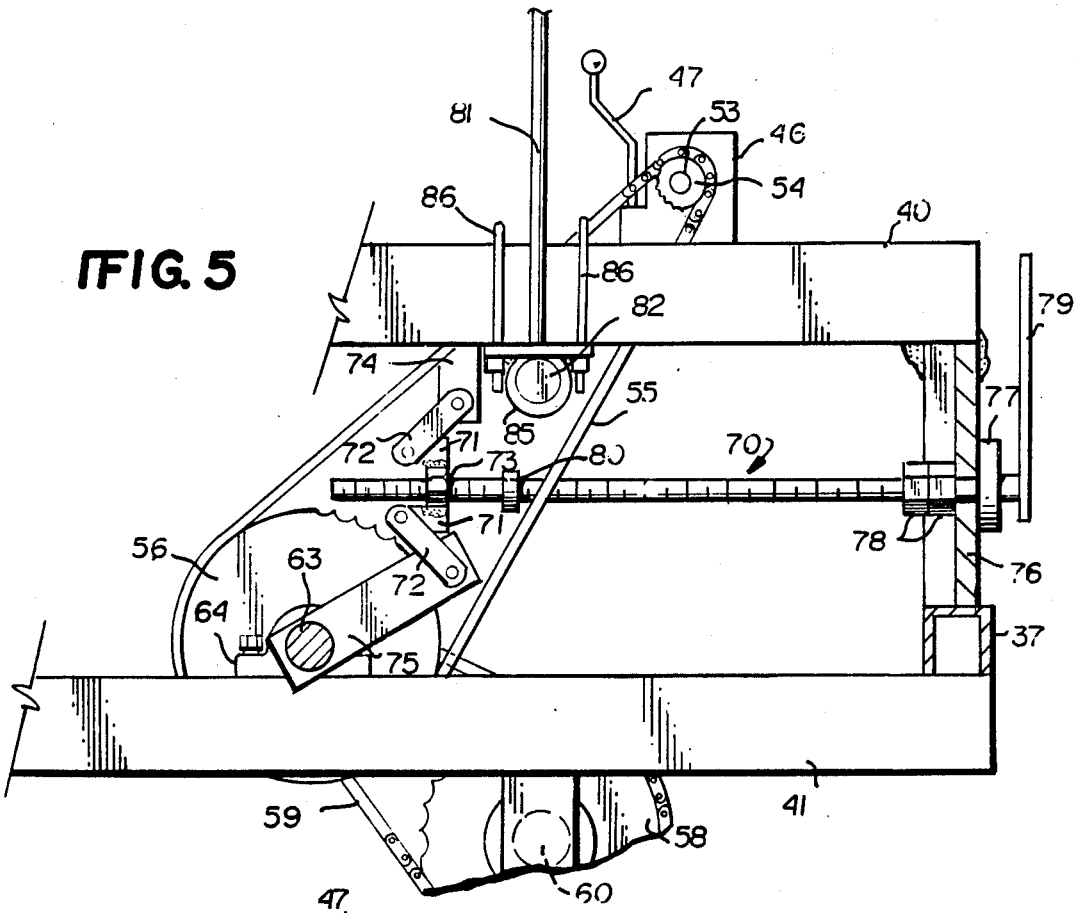
FIG. 5 is a partial side cross-sectional view taken along the line A—A of FIG. 2.

A horizontally oriented clutch output shaft 53, best seen in FIGS. 4, 5 and 6, mounts a sprocket 54 which is operatively connected by an endless chain 55 to an idler gear 56. The idler 56, and an associated smaller sprocket 57 are mounted on a shaft 63 for rotation relative to the shaft. Sprocket 57 is operatively connected to a final drive sprocket 58 via endless chain 59. Sprocket 58 is mounted for rotation on a live drive axle shaft 60, approximately midway along the length of the axle.

At either end of the live axle 60 there is mounted a drive wheel 61. The drive wheels are preferably 10.5 inches in diameter and are spaced approximately 18 feet apart, so that the wheels are located approximately 1 foot inwardly of the outer ends of the frame center section 31.

The above described drive train effects an overall 115:1 reduction between the motor output shaft and the drive axle.

With reference to FIGS. 2, 4, 7, 8, 11 and 12, the live axle 60 is supported at its ends by outboard bearings (not shown) associated with a pair of end plates 62, 62 which pivotally mount the drive axle 60 and drive wheels 61, 61 to the frame via a rotatable torsion shaft 63, which extends along substantially the length of the center section 31, substantially parallel to the drive axle 60. Shaft 63 is supported by a plurality of bearing blocks 64 mounted on the front-to-rear lower connector beams 41.

Shaft 63, which is preferably on the order of 1 inch in diameter, acts as a torsional spring which is rotatable about ±25° from a neutral position. The neutral position is defined as that in which drive wheels 61, 61 are in light contact with a flat ground surface. With particular reference to FIGS. 7 and 8, rotation of shaft 63 25° in a counterclockwise direction (as viewed in FIG. 7) from the neutral position, results in the drive wheels being lifted off the ground approximately 2½ inches, to an inoperative position illustrated in FIG. 8. Rotation of shaft 63 25° in a clockwise direction from the neutral position, results in a positive application of about 80% of the weight of the center section onto the drive wheels to enhance the traction of the unit.

Referring again to FIGS. 5 and 6, rotation of the torsional spring shaft 63 is accomplished by a manually operated screw jack 70 which actuates a toggle linkage 71, 72, via an attached thrust nut 73, operating between a fixed frame mount 74 and a crank 75 fixedly mounted for rotation with shaft 63, approximately midway along the length of the shaft. The screw jack 70 is also attached to a vertically oriented frame member 76 via a collar 77 and a pair of lock nuts 78. A handle 79 is provided to effect rotation of the screw jack causing the threaded thrust nut 73 to move axially therealong. An adjustable stop 80 is threadably mounted on the screw jack to limit movement of the thrust nut 73 toward the handle 79, and thus limit the extent of counterclockwise movement of the crank 75 (as viewed in FIG. 5). Depending on the direction of rotation of the screw jack, the toggle linkage 71, 72 will cause crank 75 to rotate shaft 63 in a clockwise or counterclockwise direction to raise or lower the drive wheels as previously described.

With reference now particularly to FIGS. 2 through 8, it may be seen that the device may be steered by the operator with the aid of a pair of steering levers 81, 81 extending substantially vertically on either side of the operator chair 42.

Each steering lever is connected to a respective steering shaft 82 which, in turn, is connected to an associated end plate 62 by a crank arm 83 fixed to the shaft and a push-pull rod 84, which may be in the form of an adjustable turnbuckle device.

When one of the steering levers 81, for example the lever 81 illustrated in FIG. 5 which corresponds to lever 81 to the left of the driver seat in FIG. 3 is pulled rearwardly, shaft 82 is caused to rotate in a clockwise direction (as viewed in FIG. 5) so that the associated crank arm 83 rotates in the same direction, causing end plate 62 to rotate in a counterclockwise direction about shaft 63 to thereby lift the drive wheel 61 off the ground. This drive wheel, to the left of the operator chair in FIG. 3, would normally be referred to as the right drive wheel, as viewed by the operator with the machine traveling in a forward direction. It will be appreciated that if this right drive wheel is raised off the ground, losing traction, the left drive wheel will pull the left side of the unit ahead of the right side, causing the unit to turn to the right. In other words, actuation of the left or right steering lever produces, in effect, a braking action on that side of the machine and a consequent turning toward the braked side.

The steering action produced by actuation of one or the other of the levers 81, 81 is made possible by the mechanical properties of the live axle shaft 60 and the torsion spring shaft 63. The drive axle 60 is designed with high torsional stiffness and low bending stiffness. The torsion spring shaft 63, on the other hand, is designed with low torsional stiffness. Thus, shaft 63 is able to absorb the torsional or twisting forces applied when the steering levers are actuated, with only minimal stress on the screw jack mechanism 70. At the same time, the lower bending stiffness of the live axle 60 permits one drive wheel to be lifted off the ground while the other wheel maintains its full tractional engagement.

The high torsional stiffness of the drive axle is desirable for reasons associated with the spreading of the coating material by the squeegee and brush arrangement described in detail hereinbelow.

Based on experiments, the frictional resistance of pushing the squeegee and brush arrangement of the lead applicator, and simultaneously pulling the brushes of the trailing applicator across a concrete surface, has a static value of about 600–650 lbs., and a dynamic value of about 400–450 lbs. Under normal conditions, this force is fairly evenly distributed along the approximate width of the unit, and the tractive requirement for each drive wheel 61 is approximately equal. However, when one side of the unit experiences more drag, the drive wheel on that side must apply an increased tractive force in order for the unit to maintain straight line movement. If the live drive axle 60 were not stiff in torsion, this increased torque demand would allow this wheel to be torsionally deflected behind the other wheel, causing the unit to stray off course. The torsionally stiff drive axle minimizes this tendency.

The entire unit, i.e., all three frame sections, is supported on a plurality of 360° swivel casters 86 which allow the unit to be pushed or pulled in any direction when the drive wheels 61 are in a disengaged, or inoperative position. It will be understood that two pair of casters 86 located at either end of the center section 31, as well as two pair of casters supporting each side section 32 and 33, remain in ground engaging contact at all times, with the exception explained further hereinbelow relating to the use of one or more transport dollies.

An additional pair of casters 87, 87 are mounted intermediate the ends of the center section 31, as best seen in FIG. 4. These casters are mounted adjacent the drive sprocket 58 and, under normal circumstances, do not touch the ground. In this regard, casters 86 preferably have a diameter of six inches, while casters 87 preferably have a diameter of five inches. The purpose of casters 87 is to prevent the drive sprocket 58, which has a ground clearance of about 1 inch, from dragging on high spots as the unit is transported, or is in operation over an uneven surface. In addition, if the weight of the center section 31 is carried only on the two pair of end casters 86, and the surface is relatively flat, then the weight of the center section is evenly distributed to each pair of the end casters. If, on the other hand, casters 87 were also a full six inches in diameter, and if they were to engage a high spot, casters 87 would then support most of the weight of the center section and cause unsightly and unacceptable grooves to be formed in the surface.

Along the front face F of the device, lower front beams 36 and 36' of frame sections 31, 32 and 33 pivotally mount a respective channel member 90, 91 and 92. The channel members, like the frame sections, are in substantial axial alignment, so as to define substantially continuous surfaces from one end to the other.

A similar arrangement of channel members 90', 91' and 92' are pivotally supported on beams 37, 37' of the center and side frame sections, respectively, along the rear face F.

It will be understood that the side frame sections may be omitted where the width of the center section is sufficient for the particular resurfacing operation.

Since the manner in which the various channel members are supported from the various frame section beams is identical for all, only one will be described. As best seen in FIG. 9, channel member 90 is pivotally mounted to a plurality of outwardly extending pivot arms 93, via angle brackets 94 and pivot pins 95. Each arm 93 is, in turn, pivotally mounted between a pair of bracket plates 96 by a pivot pin, or bolt 97. The plates are welded to a common base plate 98 which attached to a lower front beam 36 by a pair of U-bolts 99. The arrangement is such that channel member 90 is freely floatable relative to the center frame section. Each of the remaining channel members 91, 92, 90', 91' and 92' are similarly mounted to respective frame sections along the front and rear faces of the device. While the mounting arrangement of the three channel sections along each of the front and rear of the unit is similar, the smoothing and spreading devices attached to the front or forward channel members which define the lead applicator, are arranged differently than those on the rear channel members which define the rear applicator as further described below.

Each of the axially aligned forward channels 90, 91 and 92, mount a dual configuration of resurfacing material spreading and smoothing devices including a leading squeegee-type flexible blade and a trailing bristle brush in a substantially continuous arrangement across the front face of the unit. Since each of the squeegee/-brush arrangements supported on the forward channels 90, 91 and 92 are identical, only the center section channel 90 will be described in detail. As best seen in FIG. 9, the channel member 90 includes a forward flange 110 and a trailing flange 111. The forward flange supports a flexible, squeegee-type blade 112, while the trailing flange supports a bristle brush 113. Fasteners 114, which may be bolts, screws, rivets or the like, are used to attach the blade and brush to the channel flanges.

The squeegee-type blade 112 is preferably a 0.025 inch thick, 60 Durometer Neoprene TM material, preferably about 4 inches in length, i.e., top to bottom. It will be understood, of course, that other suitable materials may be employed in the blade construction.

Brush 113 is preferably a polypropylene composition, with individual bristles being about 0.022 inches in diameter and about 4.50 inches in length. Here again, other suitable material may be used in forming the brush.

Figure 16:
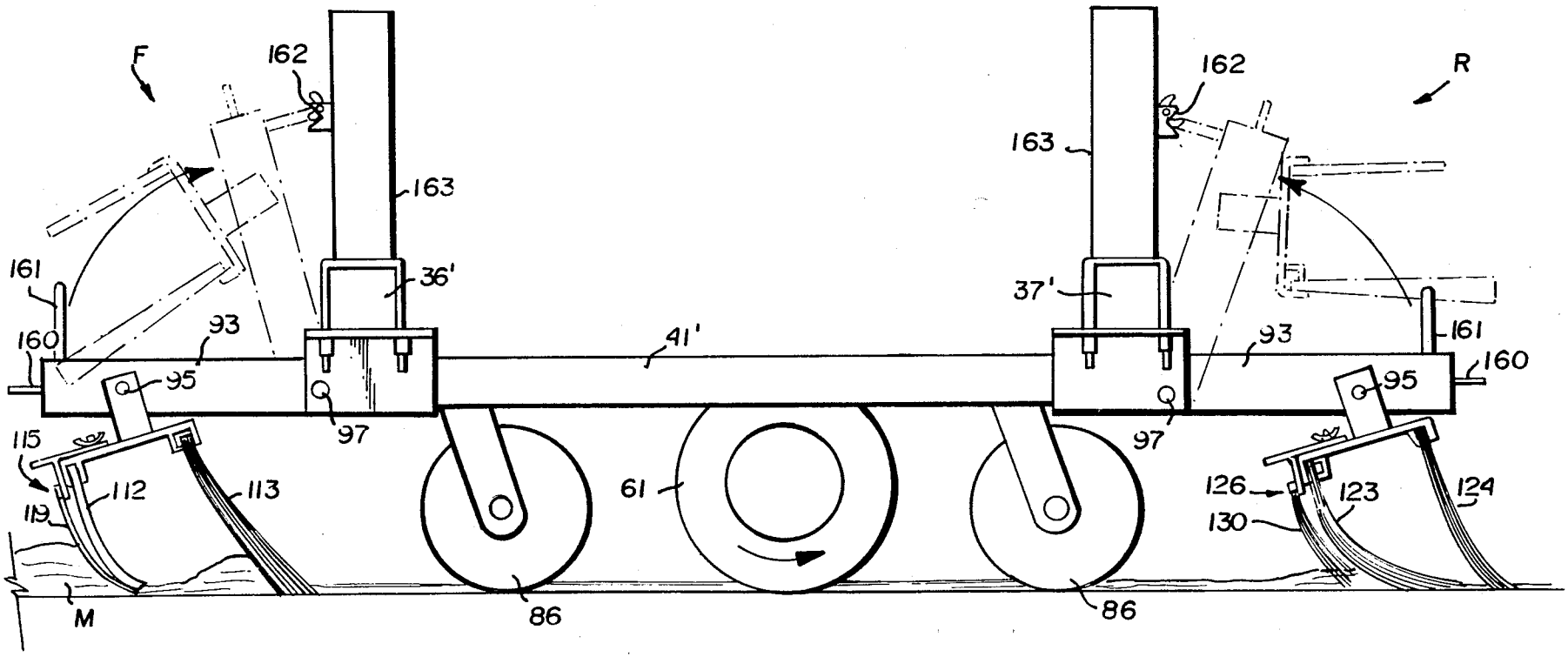
FIG. 16 is a partially schematic end view of the apparatus in accordance with an exemplary embodiment of the invention.

The arrangement of the blade and brush on the channel sections of the forward applicator is such that substantial bending or flexing occurs as the machine moves forwardly. This is best seen in FIGS. 9 and 16. As a result of this arrangement, puddles of sealant over low spots is avoided, as described in greater detail below.

As stated earlier, the channel sections 90, 91 and 92 are in substantial axial alignment. Nevertheless, there is a relatively small gap between adjacent sections, as clearly seen in FIGS. 2 and 11. To foreclose the possibility of an irregular surface pattern being formed by reason of such a gap, a pair of gap seal devices 115 are employed at the juncture of the center channel 90 with side channels 91, 92, respectively, of the forward applicator. Each gap seal device, best seen in FIGS. 10 and 11, includes an angle bracket 116, a mounting arm 117 welded or otherwise attached to the bracket, and which is provided at one end with an axial slot 118. The angle bracket 116 supports, by bolts, rivets or other suitable fasteners 114, a squeegee-type blade 119 which overlaps adjacent blades 112 of adjacent channel members. The gap seal blade 119 is preferably about 0.062 inches thick and about 4.50 inches in length (top to bottom). This thinner, and slightly longer blade curls under the main blade sections 112 during resurfacing to assure a smooth, continuous surface during spreading of the acrylic or other resurfacing material. The gap seal devices 115 are mounted at either end of the center channel member 90 by means of suitable fasteners, such as bolts and associated wing nuts 120. The slots 118 permit adjustment of the gap seal devices relative to the channel and main blade.

With reference to FIG. 10A, a preferred gap seal device for the leading applicator is illustrated in accordance with this continuation-in-part application. Reference numerals used in FIG. 10A are identical to those in FIG. 10 for like elements. Thus, the device 200 includes an angle bracket 116 which supports a squeegee-type blade 119 via fasteners 114 or other suitable means. In this alternative embodiment, however, an extended mounting arm 201 straddles channel 90 and is welded or otherwise attached to an angle bracket 202 which mounts a gap brush 203 in the same manner as bracket 116 mounts the squeegee-type blade 119. An elongated slot 204 in the mounting arm, in conjunction with a mounting bolt and associated wing nut 120 or the like, permit sliding, front-to-back (or vice versa) adjustment of the gap seal device, relative to the channel 90. The addition of a gap brush on the forward applicator provides even further assurance that no irregularity in the surface pattern is formed at the connection of the center and side frame sections.

With reference now to FIGS. 2 and 12, it may be seen that along the rearward face R of the unit, channels 90', 91' and 92' mount identical brush elements (constituting the trailing applicator) and, as such, only the center channel section will be described in further detail. Rearward center channel member 90' is provided with a leading flange 121 and a trailing flange 122. Flange 121 supports a leading bristle brush 123 while flange 122 supports a trailing bristle brush 124. The brushes are fastened to the respective flanges by suitable fasteners 125 which may be bolts, rivets or the like.

As in the case of the forward channel members, gaps exist between rearward center channel 90' and respective side channel members 91' and 92'. Accordingly, a pair of gap brush devices 126 are provided, one of which is illustrated in FIG. 12. The gap brush device 126 is similar to the gap blade device 115 insofar as it includes an angle bracket 127 attached to a mounting arm 128 provided with an adjustment slot 129. The angle bracket supports a gap seal brush 130 similar to main brushes 123, 124. Unlike the blade gap devices, however, brushes 130 are not designed to curl underneath the main brush sections 123, 124.

In FIG. 13, an alternative gap brush device 131 is disclosed for the trailing applicator wherein a brush 132 is supported from an angle bracket 133. A pair of mounting arms 134 are pivotally mounted at first ends to channel bracket 135 via a pivot pin 136, which passes through a sleeve 136' welded or otherwise fixed to the angle bracket 133, and pivotally mounted at its second ends to the angle bracket 133 via pivot pin 137 which passes through a second sleeve 137' welded or otherwise fixed to the channel bracket 135. In this arrangement, the gap brush is able to float by reason of its double pivot connection relative to the channel member 90. Bracket 135 is also slidably adjustable along the channel to enable accurate placement of the brush.

With respect to the gap seal brushes, it has been found that they work best when the bristles are thinned at opposite side edges. In other words, and with reference to FIG. **13*b*, the brush 132 is tapered at 132' on either side in directions transverse to the normal direction of movement of the brush, indicated by the arrow 190**.

Figure 13D:
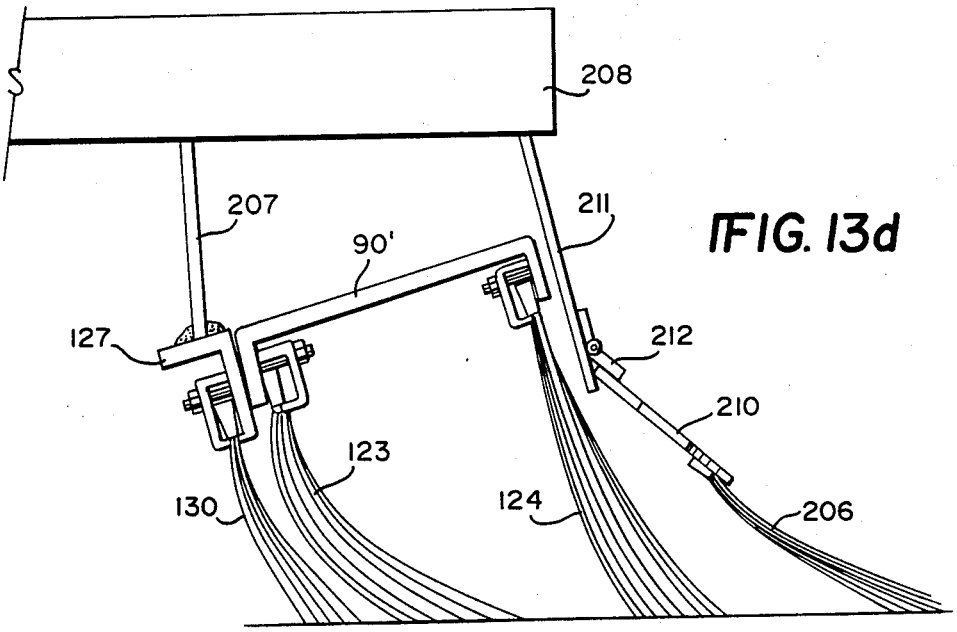
FIG. 13*d* is a partial end view of the brush gap seal device illustrated in FIG. 13*c;*

Referring now to FIGS. 13C and 13D, a preferred alternative preferred embodiment of a gap seal device for the trailing applicator is disclosed. The gap seal device 205 includes a leading gap brush 130 as shown in FIG. 12. However, in this preferred embodiment, a trailing gap brush 206 is provided, and both gap brushes 130 and 206 are supported directly by the frame members 37', 37' rather than by the channel member 90 as in the FIG. 12 embodiment. Thus, the angle bracket 127 is welded or otherwise fixed to a first mounting strap 207 which is welded or otherwise securely fixed between a pair of frame members 208, 209 arranged substantially parallel to one another.

The trailing gap brush 206 is fixed within a support member 210 which, in turn, is mounted to a second mounting strap 211 which is also welded or otherwise secured between the frame members 208, 209. Brush 206 is pivotally movable relative to the mounting strap 211 by means of a conventional hinge 212.

Frame members 208, 209 are welded or otherwise fixed at their forward ends (the ends facing the front of the machine) to a yoke member 213 which includes laterally spaced leg portions 214, 215 which extend substantially perpendicularly to the yoke member 213. The leg members, in turn, terminate in inverted U-shaped mounting elements 216, 217, respectively, which are adapted to fit snugly over the frame sections 37 and 37'. In this manner, gap brushes 130 and 206 are not subjected to vertical loading by the free-floating channel member 90' as in the FIG. 12 embodiment. In addition, by reason of hinge 212, the rear gap brush 206 is free to float relative to the surface. The described arrangement assures no difference in surface finish texture in the gap areas between the center and side frame sections of the trailing applicator. Of further note here is the fact that the trailing gap brush 206 assumes a significantly angled orientation relative to vertical to assure uniform coating in low or depressed areas which happen to coincide with a gap area.

With reference now to FIGS. 14 and 15, an optionally usable end brush device 138 is illustrated. The device includes an angle bracket 139, a bristle brush 140, a pair of mounting arms 141 and a channel bracket 142. The arms 141 are pivotally mounted at first ends to the channel bracket 142 via pivot pin 143, which passes through a sleeve 143' welded or otherwise fixed to the angle bracket 139, and at second ends to the angle bracket 139 via pivot pin 144 which passes through a sleeve 144' welded or otherwise fixed to the channel bracket 142. The double pivot arrangement allows the end brushes to float relative to their respective channel members in the same manner as the brush gap devices.

It will be understood that any other suitable means may be utilized to achieve the double pivot arrangement of both the gap seal brush shown in FIGS. 13, 13*a* as well as the end brush shown in FIGS. 14 and 15.

It will be further understood that, normally, a pair of end brushes will be used, extending substantially perpendicularly outwardly from the forward face of the unit, and specifically from the ends of side channel members 91 and 92.

The end brushes are also adjustable along the length of the respective channel members according to the width of the area to be resurfaced, and are designed to keep the initially applied resurfacing material within the court boundaries. These are particularly advantageous in two-tone resurfacing where the "in-bounds" portion of the court is one color, and the "out of bounds" portion is another color. To further facilitate the confining action of the end brush devices, each is provided with a relatively stiff, curved foot 145, constructed, for example, of steel bar stock.

Figure 15A:
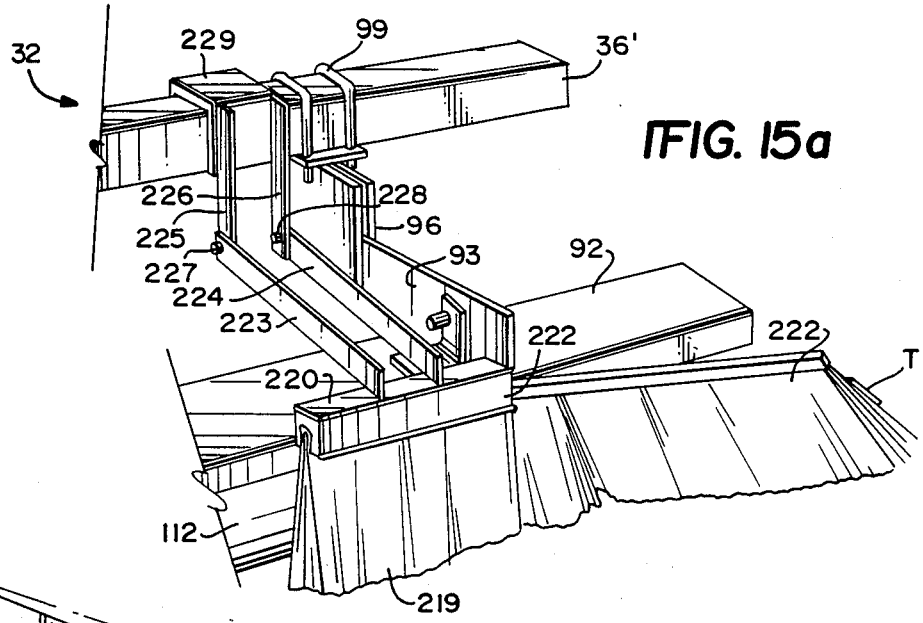
FIG. 15*a* is a partial perspective view illustrating an end brush on a leading applicator in accordance with a preferred embodiment of the invention in an inoperative mode.
Figure 15B:
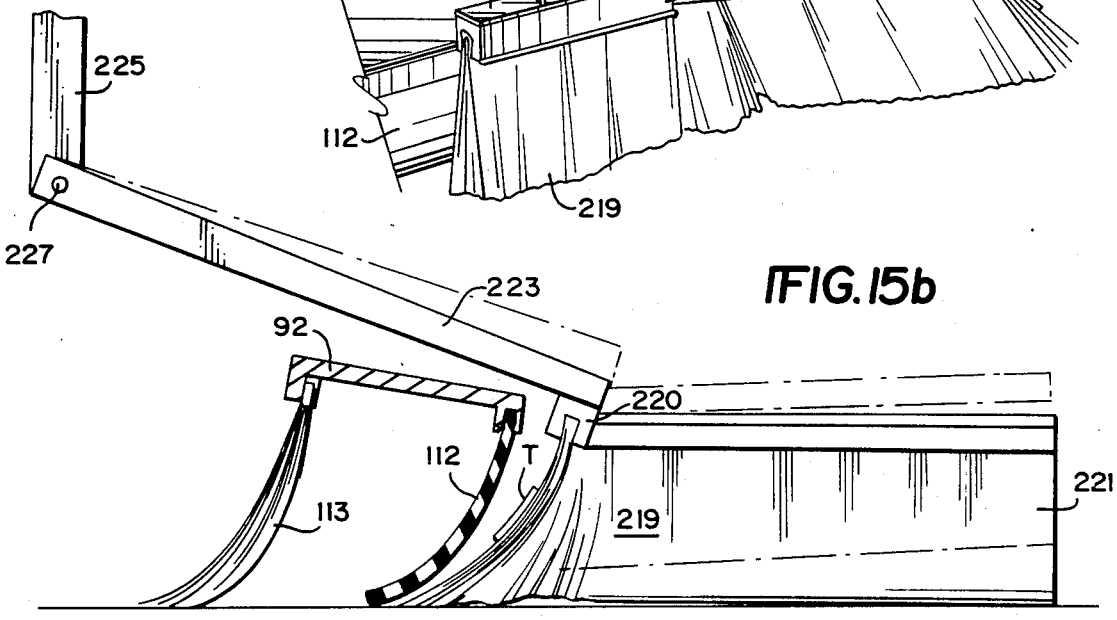
FIG. 15*b* is a partial end view of the end brush illustrated in FIG. 15*a* but in an operative mode.
Figure 15C:
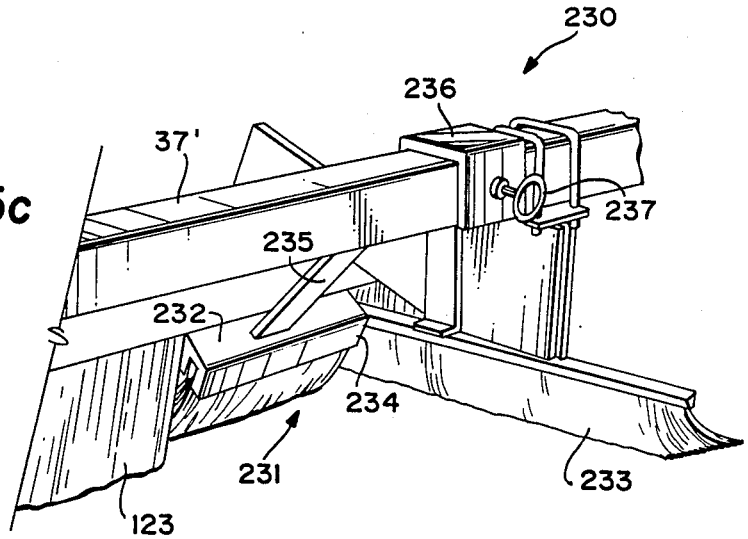
FIG. 15*c* is a partial perspective of an end brush on a trailing applicator in accordance with a preferred embodiment of the invention.

With specific reference to FIGS. 15*a* through 15*c*, preferred end brush constructions are shown for both leading and trailing applicators in accordance with this continuation-in-part application. Unlike the embodiment illustrated in FIGS. 14 and 15, where the end brushes are mounted to the corresponding channel members of the leading applicator, in this preferred embodiment, end brushes are mounted directly to the machine frame, on both front and rear faces thereof.

FIGS. 15*a* and 15*b* illustrate a leading end brush assembly mounted to the lower frame member 36' on the front face of the apparatus, adjacent one end of a separable side section 32 of the frame.

The assembly includes a brush 219 slidably mounted in a bracket 220, the holder having a length less than half the length of the brush. The free end portion 221 of the brush is bent about the end 222 of the bracket, and slightly upwardly as shown in FIG. 15*a*. The brush 219 is preferably of the same construction and bristle length as the applicator brushes previously described.

The brush holder or bracket 220 has welded or otherwise fixed thereto a pair of rigid straps 223, 224 which extend rearwardly from the end brush and are pivotally connected to a pair of substantially vertically oriented members 225, 226, respectively, by a pair of pivot pins 227, 228. Members 225 and 226 are welded or otherwise suitably secured to an inverted U-shaped bracket 229 which fits snugly over the frame member 36'.

It will be understood that the end brush as shown in FIG. 15*a* is in an inoperative position, insofar as the free end portion 221 of the brush is only partial engagement with the ground surface. However, as shown in the solid line configuration in FIG. 15*b*, once the machine is underway in a forward direction, the portion of the brush 219 which is received within the holder or bracket 220 will flex downwardly and back toward the squeegee-type blade 112, drawing the free end portion 221 of the brush down into ground surface engagement. At the same time, there may be slight pivotal movement of the rigid straps 223, 224. This pivotal movement capability also permits the end brush assembly to be pivoted away from the applicator channel 92, allowing the latter to be pivoted upwardly to its inoperative position without having to first remove the end brush assembly. The pivotal movement of the applicators is described in greater detail below. It is to be noted that the angle of the bend in the brush 219 may be in the range of about 65°–90° and preferably about 90°. As earlier indicated, the end brushes serve to confine the resurfacing composition within well defined lateral boundaries. In this regard, it will be appreciated that the bracket 229 is mounted for sliding movement along beam 36' so that, in conjunction with another, identical leading end brush at the other end of the machine, the effective width of the machine, in terms of resurfacing, may be varied virtually infinitely. The brackets 229 may be tightened in place at the desired location along the beam 36' by a thumb screw (not shown) extending through one surface of the bracket and abutting the frame member.

It will also be appreciated that the leading end brushes described above may be mounted on the separable side sections 32, 33 of the frame or, where smaller width surfaces are to be resurfaced, the end brushes may be mounted at either end of the center section 31.

Turning now to FIG. 15*c*, a preferred trailing applicator end brush assembly 230 is disclosed, it being understood that a pair of such assemblies will normally be employed, as in the case of the leading applicator end brush assemblies.

The trailing end brush assembly comprises a bristle brush 231 similar to the leading end brush 219. Here again, the brush is partially received within a bracket 232, and the free end portion 233 is bent around the end 234 of the bracket and slightly upward (in the same manner as described above with respect to the leading end brush assembly). Bracket 232 is welded or otherwise fixedly secured to a rigid strap 235 which, in turn, is welded or otherwise fixedly secured to an inverted U-shaped bracket 236, mounted on frame member 37'.

As in the case of the leading applicator end brushes, the bracket 236 is mounted for lateral adjustment along the frame member 37', and thumb screw 237 is provided to tighten the bracket in its desired location.

In use, as the machine moves in a forward direction, the brush 231 will flex under the lead brush 123 of the trailing applicator and, in doing so, the free end portion 233 will be drawn down into ground engaging contact.

For each of the leading and trailing applicator end brushes, a strip of tape T is applied across the bristles (FIGS. 15*a, b*) to hold the bristles together, particularly in the area of the bend therein, thereby preventing gaps from forming between the bristles.

Figure 20:
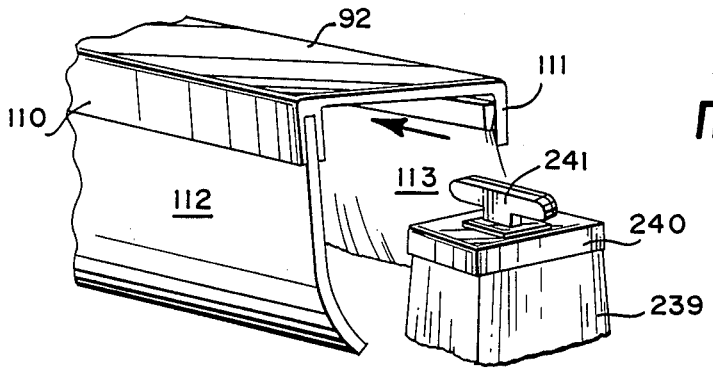
FIG. 20 is a partial perspective of an insert brush for use with the end brush assemblies.

With reference now to FIG. 20, an additional insert brush device is illustrated which is designed for use with end brush assemblies previously described. The device includes a bristle brush portion 239 attached in a holder or mounting plate 240, and to which is mounted a magnet 241. The width of the brush is such that it may be slidably received within the space formed, for example, between flanges 110, 111 of channel member 90. The brush device 238, which will be adjusted along the channel 90 to a location just behind the portion 221 of end brush 219 as illustrated in FIG. 15*a*, prevents resurfacing material from flowing outwardly between the blade 112 and brush 113, which would otherwise preclude an accurate line of demarcation defining the width of the resurfaced area. It will be understood in this regard that, preferably, four such insert brush devices are used, one with each of the leading and trailing end brush assemblies.

The manner in which the above described blades and brushes spread the resurfacing material across the surface will now be described. It is to be remembered initially in this regard that the forward and rearward channels 90, 91, 92, 90', 91' and 92' are free to float relative to the frame sections. In addition, the channel members are designed to provide good stiffness in the horizontal direction to counter the frictional resistance of the squeegee-type blades and brushes as they are pushed or pulled across the surface. At the same time, the channel members are designed to have less stiffness in the vertical direction, allowing them to "sag" along their respective lengths through any surface low spots, and to "hump" over surface high spots.

Thus, the floating action of the channels accommodates longitudinal undulations in the surface, while the low section modulus for bending allows the channels to accommodate transverse undulations.

It is also possible for the side sections 32, 33 to float to some extent relative to the center section 31 by reason of a pin and slot type hinged connection, illustrated most clearly in FIG. 11. Thus, pins 150 welded or otherwise secured to beams 36, 37 of the frame center section, are designed to fit within slots 151 provided in plate extensions 152 provided on the side section beams 36', 37'. In this manner, frame side sections 32 and 33 are free to pivot in a vertical plane about a horizontal axis relative to the frame section 31. This arrangement also provides for easy separation of the side sections for transport and/or storage.

With specific reference to FIG. 16, the lead applicator channels on the forward side F of the unit, including blades 112 (including gap seal devices 115) and brushes 113, are permitted limited rotation about pivot pins 95, 97 produced by the frictional force of the blades and brushes sliding along the surface. The rotation is stopped at a point where the lead applicator presents first the squeegee blades 112 and then the brushes 113 to the surface, with the weight of the applicator evenly distributed between the two, and so that the blades and brushes engage the resurfacing material at an angle of about 45° during forward movement of the apparatus.

The leading squeegee-type blade 112 pushes most of the resurfacing material M ahead of the unit, while allowing more than a sufficient quantity to flow underneath. The squeegee-type blades, of course, do not conform to individual surface irregularities, but, rather, bridge any small depressions, depositing acrylic material therein. The leading squeegee-type blades also contact the surface high spots and higher areas of the surface with higher interfacial pressure resulting in a thin coating in these areas. In this regard, the viscosity of the acrylic material M determines the average mil thickness of material which flows under the leading squeegee-type blades 112, including gap seal blades 119. Thus, it is important that the Durometer hardness of the squeegee and viscosity of the acrylic material be coordinated to achieve a desired coating thickness.

The trailing brushes 113 of the lead applicator follow about four inches behind the leading blades and produce a more uniform thickness and a preliminary brushed texture in the material.

To the rear of the unit, the rear applicator, including associated brushes 123 and 124 (and brush gap seal devices 126) is free to rotate about pivot pins 95, 97 to a position where substantially all of the weight of the applicator supported by the lead brush 123. This creates considerable bending deflection in the brush bristles of brushes 123 (which also engage the resurfacing material of an angle of about 45° during forward movement of the device) as well as gap seal brushes 130, with consequent higher interfacial contact pressure between the bristles and the surface.

This heavier bristle loading causes the rear applicator to brush the wetted surface to a thinner mil thickness than that left by the lead applicator. This also allows a small amount of acrylic material to build up ahead of the trailing brushes 123 which is used to cover up the drive wheel and caster tracks left in the wetted surface ahead of the rear applicator. This additional bristle deflection is also advantageous because, as the rear applicator passes over small depressions in the surface, the bristles are allowed to straighten to some extent to provide uniform contact, and thus remove the excess material deposited by the squeegee-type blades, thereby providing a very uniform mil thickness to even the smallest undulations in the surface.

The trailing brushes 124 of the rear applicator only lightly contact the wetted surface and are employed primarily to apply a finish texture to the surface.

At the same time, the above described end brushes confine the resurfacing material to a desired width and the gap seal assemblies assure uniformity of surface texture in the gap areas between the center and separable side frame sections.

In an alternative arrangement, the trailing brushes 113 of the lead applicator may be omitted, their function being performed by the brushes of the rear applicator.

FIG. 16 also illustrates a further feature of the invention related to the ability of the respective leading and trailing applicators to be pivoted upwardly to an inoperative position to facilitate transport and/or storage of the unit. To this end, handles 160 attached to the various channel members may be employed. In addition, closed loops 161 formed by U-bolts or the like, are also provided on the channel members for engaging latching devices 162 provided on the frame sections. One or more vertical posts 163 may be provided on the front and rear of the side frame sections for mounting the latching mechanism at the appropriate height while, in the center frame section, vertical posts 38 may be used. FIG. 16 illustrates in phantom, the leading and trailing applicators raised to an inoperative position.

Figure 17:
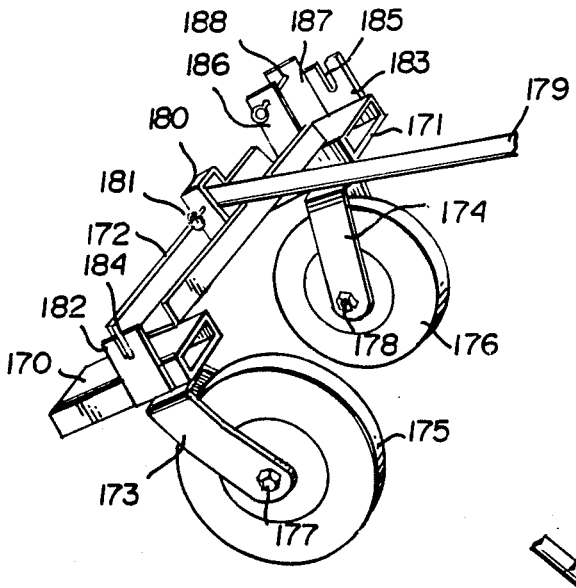
FIG. 17 is a perspective view of a transport dolly designed particularly for use with the subject invention.
Figure 18:
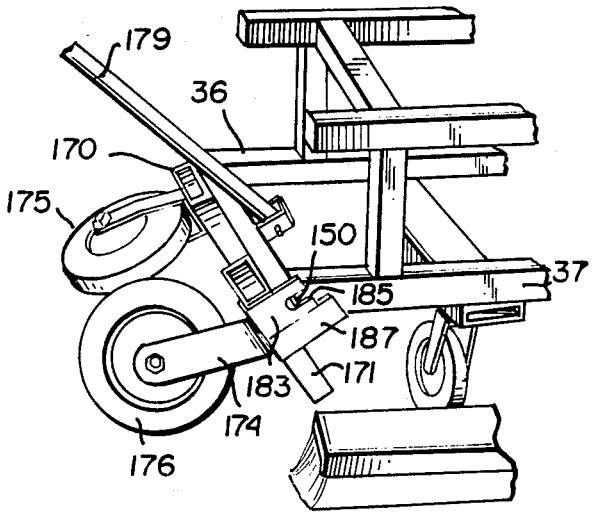
FIG. 18 is a perspective view of the transport dolly of FIG. 17 in position to be pivoted into operative association position relative to the frame center section.
Figure 19:
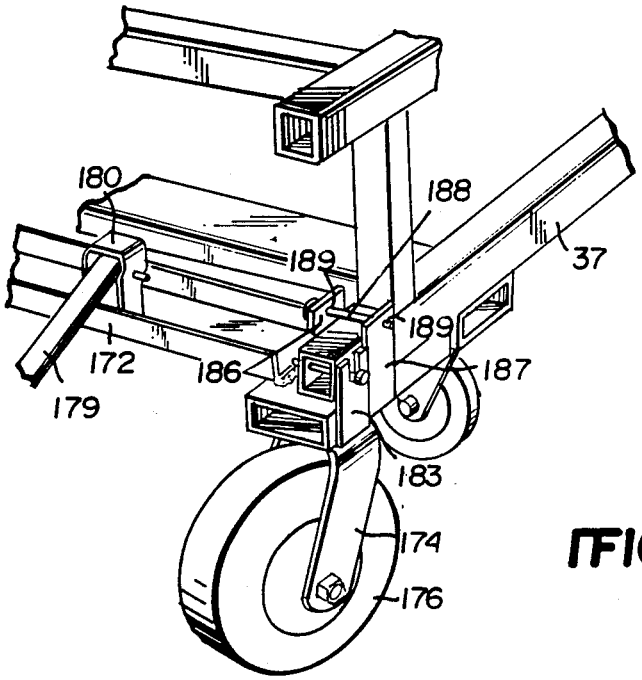
FIG. 19 is a perspective view of the transport dolly of FIG. 17 in operative position, supporting the frame center section.

With reference now to FIGS. 17 through 19, a transport dolly is illustrated for facilitating transport of the frame center section 31.

The transport dolly is formed by a pair of box beam sections 170, 171 connected by a cross beam 172. The box beams 170, 171, in turn, mount a pair of freely rotatable wheel mounting forks 173, 174, respectively. Fork 173 mounts a tire 175, preferably of the pneumatic variety, for rotation about an axle or bolt 177. Similarly, fork 174 mounts a tire 176 for rotation about an axle or bolt 178. An elongated handle 179 is pivotally mounted to the cross beam 172 via an inverted U-shaped bracket 180 and associated cotter-type pin 181.

A pair of upstanding, pin-engaging plates 182, 183 are fixed, by welding or other suitable means to the respective outer side surfaces of the box beams 170, 171. The plates are provided with open-ended slots 184, 185, respectively, extending downwardly from the tops of the plates.

In addition, at least one of the box beam sections 170, 171 is also provided with a pair of upstanding ears 186, 187, one of which may be formed as an extension of plate 183.

In use, the flat upper surfaces of box beam sections 170, 171 are adapted to engage and support the lower surfaces of beams 36, 37, respectively, while slots 184, 185 receive pins 150, 150 which are fixed to the ends of the beams 36, 37 of the frame center section. These pins, as will be recalled, normally serve as connection means for the side or wing sections. However, during transport in and out of an enclosed court area, for example, the side sections may be separated from the center section, which, of course, is the heaviest by reason of its carrying the motor, drive train, steering mechanism, etc.

Accordingly, the transport dolly is designed particularly as an aid to moving the frame center section.

With reference now to FIG. 18, the dolly is tilted to an inclined position relative to the frame center section so that slots 184, 185 may engage pins 150, 150. Once the pins are seated within the slots, handle 179 may be used as a lever to pivot the dolly in a counterclockwise direction, until box beams 170, 171 fully engage beams 36, 37. In this position, the end of the frame center section, including casters 86, are lifted approximately four inches off the ground. Subsequently, a pin 188 is inserted through aligned apertures 189 in the upstanding ears 186, 187, just above the top surface of the beam 37 so as to prevent the dolly from dropping down into the position illustrated in FIG. 18.

With the transport dolly in place, handle 179 may be used to pull the frame center section with relative ease, due in large part to the relatively large pneumatic tires 175, 176.

It will be appreciated that if desired, a second dolly may be employed at the other end of the frame center section, although usually not required. Thus, the use of transport dollies is designed to facilitate movement to and from a court area, loading and off-loading vis-a-vis a truck bed, etc. while casters 86 are sufficient to move the apparatus about a court, and to or from adjacent courts during a resurfacing operation.

Referring back now to FIGS. 1 and 1*a*, the operation of the machine will be described in connection with a resurfacing operation for two adjacent tennis courts. This is merely exemplary of the many court or surface configurations which can be resurfaced with the unit disclosed herein. Initially, the machine 30 is placed beyond the boundary 6 of the court for movement lengthwise of the court as indicated by arrows A. Prior to machine actuation, a mass of resurfacing material M in an amount sufficient to resurface the entire court 2, is applied ahead of the machine in a manner as generally indicated in FIG. 1. Alternatively, a plurality of rows, or windrows of the resurfacing material may be deposited in front of, and parallel to, the machine with additional windrows added as needed. The first mentioned, and preferred pattern provides good spreading characteristics and minimizes the tendency of the material to flow around the side sections of the machine. In either case, it has also been found to be advantageous to spread a relatively small quantity of resurfacing material along the leading brushes of the trailing applicator to "prime" the brushes upon start up.

After application of the resurfacing material, the machine drive is actuated to cause the machine to traverse the entire length of court until it reaches a position indicated in phantom by the reference numeral 193. During this path of travel, it will be understood that the flexible squeegee-type blades and brushes of the leading applicator spread and smooth out the windrows W of resurfacing material as described above, while, at the same time, the flexible brushes of the trailing applicator smooth out and eliminate tracks and other surface irregularities caused by movement of the casters and drive wheels through the resurfacing material. The final average overall thickness of the material applied to the surface is from about 12 to about 15 mil.

Once the machine has reached the position indicated by reference numeral 193, the drive wheels are raised and the unit is swung around on its casters so that the forward face is facing the second court 3 to be resurfaced. Upon reengagement of the drive wheels, the machine is ready to traverse a path indicated by arrows B. Prior to actuation, another mass of resurfacing material would, of course, be applied to the surface of court 3, in front of the machine as described above.

Figure 1A:
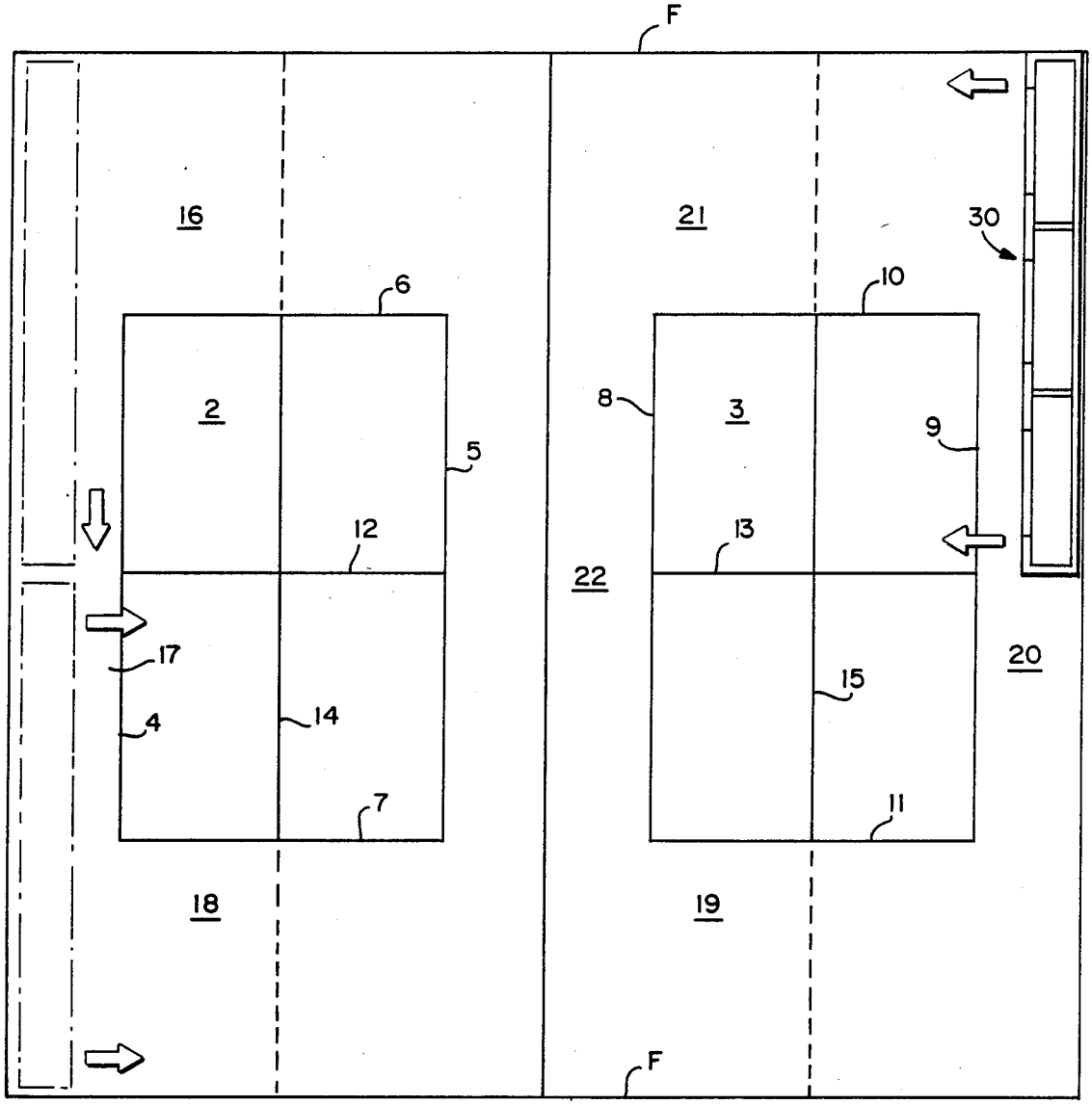
FIG. 1*a* is a schematic view of the resurfacing device shown in FIG. 1, positioned to resurface a pair of adjacent tennis courts in accordance with an alternative resurfacing procedure.

In an alternative procedure, illustrated in FIG. 1*a*, the unit may be arranged to move across the width of one or more aligned courts 2,3, such that one half of the adjacent courts are resurfaced in one pass, i.e., approximately from lines 12–13 to a barrier such as a fence F, located beyond the end lines 6, 10, while the other half of the courts are resurfaced in a return pass, i.e., between lines 12, 13 to a second barrier such as a fence F′, located beyond the opposite end lines 7, 11. The two passes are shown in FIG. 1*a* with the aid of arrows and phantom lines indicating the position of the apparatus at the different stages of the resurfacing process. It will thus be appreciated that virtually the entire slab, including the court per se and surrounding surfaces, may be resurfaced in two passes of the apparatus.

It will also be appreciated that more than one coat may be applied, as desired. In addition, where two coats are applied, application of such coats in perpendicular directions has been found to create a particularly attractive, "linen-like", or criss-cross texture to the court surface, created by the unique arrangement of brushes on the trailing applicator.

In carrying out the above described process, it is an added feature of this invention that existing painted boundary lines, service lines, etc. on the one or more courts to be resurfaced are covered with, for example, a light adhesive tape, which is removed subsequent to the application of the resurfacing material, and will not take up the paint during its removal. If the boundary lines are in need of re-painting, it is preferable that this be done prior to taping so that when the tape is subsequently removed, the process is completed.

Figure 21:
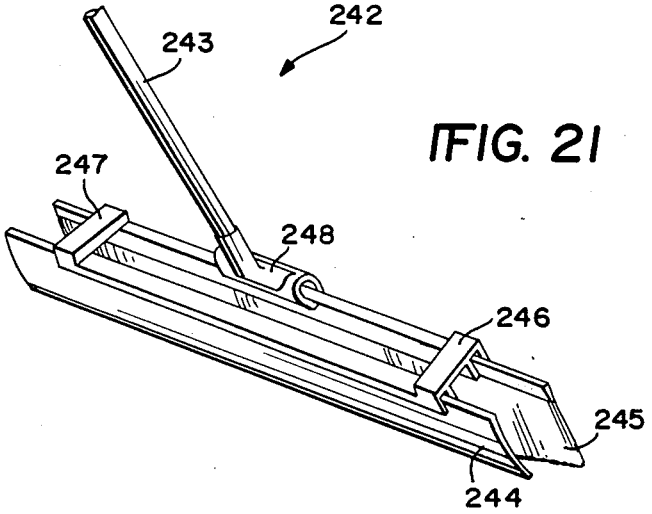
FIG. 21 is a partial perspective of a hand tool for use in carrying out the process in accordance with the invention.

With reference to FIG. 21, a manual tool 242 is illustrated which includes an elongated handle 243 and a tool mounting head 248. The latter slidably receives a surface finishing tool including a leading squeegee-type blade 244 and a trailing brush 245 spaced rearwardly from the blade 244 by a pair of brackets 246, 247. The blade and brush elements are preferably constructed of the same material as the blade and brush assemblies on the machine per se. The tool is adapted to be pulled, with blade 244 leading, so that the blade and brush assume an angle of about 45° in order to duplicate as closely as possible the resurfacing action of the machine. The tool is designed for use in confined or otherwise inaccessible areas which cannot be reached by the machine. For example, and with reference to FIG. 1, it will be appreciated that when the machine is moved laterally from court 2 to court 3 there is an area, directly under machine itself, which cannot be resurfaced, primarily because of the common practice of enclosing courts by fencing which limits the travel of the machine. In addition, when the resurfacing operation is substantially completed, the machine is typically moved to the side of the court and cleaned, e.g., by hosing it down with water if a supply is available. Once cleaned and removed, there may remain an adjacent area which needs resurfacing in order to complete the resurfacing operation. Similarly, there may be excess resurfacing material at the end of the path of travel of the machine which must be removed, but in most cases, this material can be used to cover those areas which are inaccessible by the machine. Thus, the hand tool 242 is employed to provide a finishing operation as needed.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A method of resurfacing a surface comprising the steps of:

(a) providing a self-propelled resurfacing device including at least a pair of drive wheels, said device having front and rear faces, and provided with free-floating, spreading and smoothing means on said front and rear faces, the device further including end brush means mounted on said frame in laterally spaced relationship, said end brush means laterally adjustable along at least said front face;

(b) aligning said device along one end portion of the surface;

(c) adjusting said end brush means along the frame to establish a desired lateral space therebetween;

(d) depositing a mass of resurfacing material on said surface along the said front face of the device; and (e) moving said device across said surface so that said spreading and smoothing means spreads and smooths said resurfacing material uniformly across at least the entire surface between said end brushes, and wherein said spreading and smoothing means erases tracks in said resurfacing material caused by said drive wheels.

2. A method as defined in claim 1, wherein said resurfacing material is an acrylic composition.

3. A method as defined in claim 1, wherein said free floating spreading and smoothing means comprise at least leading flexible blade means extending along said front face of the device, and adapted to engage said surface at a substantial angle relative to vertical during forward movement.

4. A method as defined in claim 3, wherein said spreading and smoothing means also comprise at least leading brush means extending along the rear face of the device, so that during the practice of step (e), the spreading and smoothing means apply said resurfacing material at a uniform thickness across said surface.

5. A method as defined in claim 1 and including the further step of manually spreading said resurfacing material in areas to be resurfaced which are otherwise confined and which cannot be reached by the resurfacing device.

6. Resurfacing apparatus comprising:

frame means provided with front and rear faces;

a plurality of wheel means mounted on the underside of said frame means between said front and rear faces;

free floating flexible blade means mounted on, and extending along said front face of said frame, and free floating brush means mounted on, and extending along said rear face of said frame, and end brush means mounted along, and extending forwardly and substantially perpendicularly to each of said front and rear faces;

said flexible blade, brush and one portion of said end brush means adapted to engage a mass of resurfacing material applied to a surface at an angle of about 45° relative to vertical during forward movement of the apparatus.

7. Apparatus as defined in claim 6, wherein free floating brush means are also mounted to said frame across the front face thereof, but behind said flexible blade means.

8. Apparatus as defined in claim 6, wherein said flexible blade means are constructed of a rubber composition, and wherein said brush means are constructed of polypropylene.

9. Apparatus as defined in claim 6, wherein said frame means comprise a center section and two separable side sections.

10. Apparatus as defined in claim 6 wherein said one portion of said end brush means extends substantially parallel to said flexible blade and brush means, and another portion of said end brush means extends at an angle of between about 65° and 90° relative to said one portion.

11. Apparatus as defined in claim 6 and wherein said end brush means are mounted for sliding movement along said frame means.

12. Apparatus as defined in claim 9 and further including gap seal means on said front and rear faces for bridging gaps formed between said center section and each of said separable side sections.

13. Apparatus as defined in claim 12 wherein said gap seal means on said front face includes gap blade means and gap brush means connected to each other.

14. Apparatus as defined in claim 13 wherein said gap seal means on said rear face includes gap brush means mounted to said frame means.

15. Resurfacing apparatus for uniformly spreading material across a surface comprising:

a frame including a front face and a rear face;

a leading material applicator extending from said front face and including leading squeegee-type blade means and first trailing brush means;

a trailing material applicator extending from said rear face and including at least leading brush means, wherein said leading and trailing applicators are mounted for free floating pivotal motion relative to said frame, and wherein a pair of end brush devices are provided for each of the front and rear faces of said frame, said end brushes extending substantially perpendicularly with respect to said front and rear applicators and adapted for sliding movement along said front and rear faces of said frame.

16. Apparatus according to claim 15 wherein said trailing material applicator further includes trailing brush means.

17. Apparatus according to claim 15 and further including first insert brush means attachable to said leading material applicator between said leading squeegee-type blade means and said first trailing brush means.

18. Apparatus according to claim 17 and further including second insert brush means attachable to said trailing material applicator behind said trailing brush means.

19. Apparatus according to claim 15 wherein said trailing applicator includes leading and trailing brush means.

20. Apparatus according to claim 19 and further including second insert brush means attachable to said trailing applicator between said leading and trailing brush means.

21. Apparatus according to claim 15 wherein said frame and said leading and trailing applicators are constructed in three separable, and substantially axially aligned sections, including a center section and two side sections.

22. Apparatus according to claim 21 wherein said leading and trailing applicators are provided with means for sealing gaps between the axially aligned center and side frame sections.

23. Apparatus according to claim 22 wherein said means for sealing gaps includes a pair of gap seal blade and brush devices mounted on said center section of said leading applicator.

24. Apparatus according to claim 22 wherein said means for sealing gaps includes a pair of gap brush devices mounted on said rear face of said frame.

25. Apparatus according to claim 23 wherein said means for sealing gaps includes a pair of gap brush devices mounted on said rear face of said frame.

* * * * *